US006391536B2

(12) United States Patent
Yasuda et al.

(10) Patent No.: US 6,391,536 B2
(45) Date of Patent: May 21, 2002

(54) THERMALLY PROCESSED IMAGE RECORDING MATERIAL

(75) Inventors: Tomokazu Yasuda; Hajime Nakagawa, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/773,569

(22) Filed: Feb. 2, 2001

(30) Foreign Application Priority Data

Feb. 2, 2000 (JP) ..... 2000-024883

(51) Int. Cl.[7] ..... G03C 1/498
(52) U.S. Cl. ..... 430/619; 430/531
(58) Field of Search ..... 430/619, 531, 430/617, 138

(56) References Cited

U.S. PATENT DOCUMENTS 6,309,814 B1 * 10/2001 Ito ..... 430/619

6,329,134 B1 * 12/2001 Watanabe et al. ..... 430/619

* cited by examiner

*Primary Examiner*—Thorl Chea
(74) *Attorney, Agent, or Firm*—Birch, Stewart, Kolasch & Birch, LLP

(57) ABSTRACT

Disclosed is a thermally processed image recording material having an image-forming layer that contains a non-photosensitive silver salt of an organic acid, a reducing agent for silver ions and a binder on a support, wherein the binder is coated as a dispersion of polymer microparticles having a core/shell structure, glass transition temperature of shell part of the core/shell structure is higher than glass transition temperature of core part, and the binder shows a minimum film-forming temperature of 30° C. or lower. According to the present invention, there is provided a thermally processed image recording material that provides improved image storability after heat development, i.e., improved coloration of white portions when the material is left at a high temperature, and has a transparent coated film with low haze that is also excellent in brittleness.

20 Claims, No Drawings

THERMALLY PROCESSED IMAGE RECORDING MATERIAL

FIELD OF THE INVENTION

The present invention relates to a thermally processed image recording material. In particular, the present invention relates to a thermally processed image recording material that shows superior image storability after heat development.

RELATED ARTS

There are known many photosensitive materials having a photosensitive layer on a support, with which image formation is attained by imagewise light exposure. Those materials include those utilizing a technique of forming images by heat treatment as systems that can contribute to the environmental protection and simplification of image forming means.

In recent years, reduction of amount of waste processing solutions is strongly desired in the field of films for medical use and the field of photographic art films from the standpoints of environmental protection and space savings. Therefore, development of techniques relating to thermally processed image recording materials for medical diagnosis films and photographic art films are required, which materials enables efficient exposure by a laser image setter or laser imager and formation of a clear black image having high resolution and sharpness. Such thermally processed image recording materials can provide users with a simple and non-polluting heat development processing system that eliminates the use of solution-type processing chemicals.

Among such thermally processed image recording materials, those materials for medical images are required to provide high quality of images excellent in sharpness and graininess, since such images are required to be very fine images. In addition, for easy diagnosis, cold monochromatic images are preferred. At present, various types of hard copy systems using pigments and dyes, for example, ink jet printers and electrophotographic systems, are available as ordinary imaging systems. However, no satisfactory image-forming system is available for medical images.

Methods for forming images by heat development are described in, for example, U.S. Pat. Nos. 3,152,904 and 3,457,075 and Klostervoer, "Thermally Processed Silver Systems", Imaging Processes and Materials, Neblette, 8th ed., compiled by J. Sturge, V. Walworth and A. Shepp, Chapter 9, p. 279, (1989). Such photothermographic materials comprise a reducible non-photosensitive silver salt (e.g., silver salt of an organic acid), a photocatalyst (e.g., silver halide) in a catalytically active amount and a reducing agent for silver, which are usually dispersed in an organic binder matrix. While the photosensitive materials are stable at an ordinary temperature, when they are heated to a high temperature (e.g., 80° C. or higher) after light exposure, silver is produced through an oxidation-reduction reaction between the reducible silver salt (which functions as an oxidizing agent) and the reducing agent. The oxidation-reduction reaction is accelerated by catalytic action of a latent image of silver halide generated upon exposure. The silver resulted from the reaction of the reducible silver salt in the exposed areas shows black color that provides contrast with respect to the non-exposed areas, and thus images are formed. Thermally processed image recording materials and systems therefor based on the above principle are disclosed in many references including U.S. Pat. No. 2,910,377 and Japanese Patent Publication (Kokoku, hereinafter referred to as JP-B) 43-4924.

However, since such thermally processed image recording materials are not subjected to a fixation treatment after the heat development, they suffer from a problem that the silver salt of an organic acid, and possibly a photosensitive silver halide, when the materials are photothermographic materials, are left as they are in the materials even after the heat development, and thus white portions are colored when the materials are left at a high temperature for a long period of time after the heat development.

SUMMARY OF THE INVENTION

Therefore, an object of the present invention is to provide a thermally processed image recording material that shows improved image storability after the heat development, i.e., that shows improved coloration of white portions observed when the material is left at a high temperature. Another object of the present invention is to provide a thermally processed image recording material that comprises a transparent layer showing low haze and superior brittleness.

The inventors of the present invention assiduously studied in order to achieve the aforementioned objects. As a result, they found that an excellent thermally processed image recording material that provides the desired effects could be obtained by using a dispersion of polymer microparticles having a core/shell structure which satisfies particular requirements as a binder, and thus accomplished the present invention.

That is, the present invention provides a thermally processed image recording material having an image-forming layer that contains a non-photosensitive silver salt of an organic acid, a reducing agent for silver ions and a binder on a support, wherein the binder is coated as a dispersion of polymer microparticles having a core/shell structure, glass transition temperature of shell part of the core/shell structure is higher than glass transition temperature of core part, and the binder shows a minimum film-forming temperature of 30° C. or lower.

The glass transition temperature of the core part of the core/shell structure is preferably 10° C. or lower, and the glass transition temperature of the shell part is preferably 40° C. or higher. Further, the dispersion of polymer microparticles is preferably latex prepared by emulsion polymerization. Furthermore, the image-forming layer preferably contains a photosensitive silver halide.

According to the present invention, there can be provided thermally processed image recording materials that provide improved image storability after heat development, i.e., improved coloration of white portions when the materials are left at a high temperature, and have transparent coated films with low haze that are also excellent in brittleness.

DETAILED DESCRIPTION OF THE INVENTION

The present invention will be explained in detail hereafter.

The thermally processed image recording material of the present invention has an image-forming layer that contains a non-photosensitive silver salt of an organic acid, a reducing agent for silver ions and a binder on a support. The aforementioned image-forming layer preferably further contains a photosensitive silver halide. In this case, the image-forming layer is a photosensitive layer, and the thermally processed image recording material of the present invention includes a photothermographic material.

The binder used for the image-forming layer of the thermally processed image recording material of the present invention is characterized in that it is provided by coating a dispersion of polymer microparticles that have a core/shell structure, the glass transition temperature of the shell part of the core/shell structure is higher than that of the core part, and the minimum film forming temperature of the binder is 30° C. or lower. The image-forming layer is preferably formed by coating and drying the coating solution which is prepared by mixing a dispersion of the aforementioned polymer microparticles with other ingredients.

The binder of the image-forming layer serves as a field of the image formation by the heat development, and provides a storage environment for the picture elements during image storage. The aging stability of the images formed by the development is greatly affected by the environment surrounding the silver grains that can be picture elements. Thermally processed materials, in particular, do not undergo a fixation reaction process as described above, and therefore non-imagewise development may occur even after the image formation. In the thermally processed materials, in general, significant improvement in storage stability can be obtained by reducing diffusibility of the compounds involved in the development process which present around the developable silver grains that can form picture elements under the storage condition. That is, by increasing the glass transition temperature (also referred to as Tg hereinafter) of the binder being in contact with the image silver grains, the motility of low molecular weight compounds is reduced and thus improvement of the image storability can be attained. On the other hand, when Tg is increased, the binder system usually suffers from a problem that the film-forming temperature (minimum film forming temperature: hereinafter also abbreviated as MFT) is elevated due to the increase of Tg, and thus sufficient film-forming property can no longer be obtained. The technical characteristic of the binder of the image-forming layer of the present invention is that higher Tg of the polymer field contacting with the silver images and impartation of film-forming property obtained by the deformation of particles can be simultaneously obtained by elevating Tg of particle surfaces and lowering Tg of the inside of the particles.

The binder of the image-forming layer is provided by coating a dispersion of polymer microparticles having a core/shell structure, and the glass transition temperature of the shell part of the core/shell structure is higher than that of the core part. That is, the dispersion consists of soft core/hard shell latex (also abbreviated as "SC-HS latex" hereinafter). The difference of the glass transition temperature of the core part and the glass transition temperature of the shell part is preferably 30–130° C., more preferably 55–100° C. In the present specification, the range indicated with "-" means a range including the numerical values before and after "-" as the minimum and maximum values.

The glass transition temperature of the core part is preferably 10° C. or lower, more preferably −30–10° C., further preferably −20–5° C., in view of film-forming property, brittleness and so forth. The glass transition temperature of the shell part is preferably 40° C. or higher, more preferably 50–100° C., further preferably 60–80° C., in view of image storability.

Monomers that can be used as raw materials of the polymers for the core part and the shell part are not particularly limited, and those polymerizable by ordinary radical polymerization or ion polymerization can suitably be used. Preferably, the polymers of the core part and the shell part are homopolymers or copolymers of monomers arbitrarily selected from the monomers mentioned below so that the aforementioned relationship of the glass transition temperatures of the core part and the shell part could be satisfied.

Monomers (a) Olefins: ethylene, propylene, isoprene, butadiene, pentadiene, cyclopentadiene, vinyl chloride, vinylidene chloride, 6-hydroxy-1-hexene, 4-pentenoic acid, methyl 8-nonenoate, vinyl sulfonate, trimethylvinylsilane, trimethoxyvinylsilane, 1,4-divinylcyelohexane, 1,2,5-trivinylcyelohexane etc.;

(b) α- and β-unsaturated carboxylic acids and salts thereof: acrylic acid, methacrylic acid, itaconic acid, maleic acid, sodium acrylate, ammonium methacrylate, potassium itaconate etc.;

(c) derivatives of α- and β-unsaturated carboxylic acids: alkyl acrylates (for example, methyl acrylate, ethyl acrylate, butyl acrylate, cyclohexyl acrylate, 2-ethylhexyl acrylate, dodecyl acrylate etc.), substituted alkyl acrylates (for example, 2-chloroethyl acrylate, benzyl acrylate, 2-cyanoethyl acrylate etc.), alkyl methacrylates (for example, methyl methacrylate, butyl methacrylate, 2-ethylhexyl methacrylate, dodecyl methacrylate etc.), substituted alkyl methacrylates (for example, 2-hydroxyethyl methacrylate, glycidyl methacrylate, glycerol monomethacrylate, 2-acetoxyethyl methacrylate, tetrahydrofurfuryl methacrylate, 2-methoxyethyl methacrylate, ω-methoxypolyethylene glycol methacrylate (added molar number=2–100), polyethylene glycol monomethacrylate (added molar number of polyoxyethylene=2–100), polypropylene glycol monomethacrylate (added molar number of polyoxypropylene=2–100), 3-N,N-dimethylamino-propyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, 2-isocyanatoethyl methacrylate etc.), derivatives of unsaturated dicarboxylic acids (for example, monobutyl maleate, dimethyl maleate, monomethyl itaconate, dibutyl itaconate etc.), polyfunctional esters (for example, ethylene glycol diacrylate, ethylene glycol dimethacyrlate, 1,4-cyelohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, 1,2,4-cyelohexane tetramethacrylate etc.);

(d) amides of β-unsaturated carboxylic acids: acrylamide, methacrylamide, N-methylacrylamide, N,N-dimethylacrylamide, N-methyl-N-hydroxyethylmethacrylamide, N-tert-butylacryl-amide, N-tert-octylmethacrylamide, N-cyclohexylacrylamide, N-phenylacrylamide, N-(2-acetoacetoxyethyl)acrylamide, N-acryloylmorpholine, diacetone acrylamide, itaconic acid diamide, N-methylmaleimide, 2-acrylamido-2-methylpropane-sulfonic acid, methylene bisacrylamide, dimethacryloylpiperazine etc.;

(e) unsaturated nitriles: acrylonitrile, methacrylonitrile, etc.;

(f) styrene and derivatives thereof: styrene, vinyltoluene, p-tert-butylstyrene, vinyl benzoate, vinyl methylbenzoate, α-methylstyrene, p-chloromethylstyrene, vinylnaphthalene, p-hydroxymethylstyrene, p-styrenesulfonic acid sodium salt, p-styrenesulfinic acid potassium salt, p-aminomethylstyrene, 1,4-divinylbenzene, 4-vinylbenzoic acid 2-acryloylethyl ester etc.;

(g) vinyl ethers: methyl vinyl ether, butyl vinyl ether, methoxyethyl vinyl ether etc.

(h) vinyl esters: vinyl acetate, vinyl propionate, vinyl benzoate, vinyl salicylate, vinyl chloroacetate etc.;

(i) other polymerizable monomers: N-vinylimidazole, 4-vinylpyridine, N-vinylpyrrolidone, 2-vinyloxazoline, 2-isopropenyloxazoline, divinylsulfone etc.

Preferably, the polymers of the core part and the shell part mainly consist of homopolymers or copolymers of acryl and methacryl resins, styrene resins, conjugated diene resins, vinyl chloride resins, vinyl acetate resins, vinylidene chloride resins, polyolefin resins and so forth. Among these, particularly preferred are homopolymers or copolymers containing one or more kinds of conjugated dienes (for example, isoprene, butadiene etc.) as the constitutive monomers.

Although the weight ratio of the core part and the shell part in the binder of the image-forming layer is not particularly limited, the weight ratio of the core part accounts for usually 10–90 weight %, preferably 20–80 weight %, more preferably 30–70 weight %.

The minimum film-forming temperature of the binder of the image-forming layer is 30° C. or lower, preferably −50–20° C., more preferably −20–15° C.

Preferred examples of polymers of the core part and the shell part for the binder of the image-forming layer are mentioned in Table 1 below. However, the present invention is not limited to these.

The numerals used herein for the composition ratios of the monomers and the core/shell ratios indicate weight percents, and molecular weights indicate number average molecular weights, unless otherwise indicated. As for the cases where a polyfunctional monomer is used, description is omitted because the concept of molecular weight is not applicable. Glass transition temperature is indicated as Tg.

Tg was calculated according to the following equation.

$$1/Tg=\Sigma(Xi/Tgi)$$

In the equation, it is assumed that a polymer consists of n of copolymerized monomers. Xi represents a weight ratio of i-th monomer (Σxi=1), and Tgi represents glass transition temperature (absolute temperature) of a homopolymer of the i-th monomer. Σ means the sum of from i=1 to n. As the values of glass transition temperature of homopolymers (Tgi), employed are those mentioned in J. Brandrup and E. H. Immergut, Polymer Handbook (3rd Edition), Wiley-Interscience (1989)).

The minimum film-forming temperature (MFT) was measured by using a film-forming temperature measurement apparatus (MFT-1) produced by Yoshimitsu Seiki.

TABLE 1

| No. | Structure | | Core/shell ratio | Tg (° C.) | Molecular weight | Concentration (wt %) | Particle diameter (nm) | MFT (° C.) |
|---|---|---|---|---|---|---|---|---|
| P-1 | Core | Styrene (35)/butadiene (65) | 50 | −46 | Crosslinked | 40.3 | 107 | 13 |
| | Shell | Styrene (100) | 50 | 100 | 84000 | | | |
| P-2 | Core | Styrene (50)/butadiene (50) | 50 | −23 | Crosslinked | 36.9 | 112 | 2 |
| | Shell | Styrene (85)/butadiene (12)/acrylic acid (3) | 50 | 52 | Crosslinked | | | |
| P-3 | Core | Styrene (60)/butadiene (40) | 50 | −5 | Crosslinked | 38.9 | 96 | 8 |
| | Shell | Styrene (85)/butadiene (12)/acrylic acid (3) | 50 | 52 | Crosslinked | | | |
| P-4 | Core | Styrene (63)/butadiene (37) | 35 | 0 | Crosslinked | 39.6 | 106 | 14 |
| | Shell | Styrene (88)/butadiene (10)/acrylic acid (2) | 65 | 67 | Crosslinked | | | |
| P-5 | Core | Styrene (63)/butadiene (37) | 50 | 0 | Crosslinked | 39.9 | 110 | 11 |
| | Shell | Styrene (88)/butadiene (10)/acrylic acid (2) | 50 | 67 | Crosslinked | | | |
| P-6 | Core | Styrene (63)/butadiene (37) | 60 | 0 | Crosslinked | 40.2 | 92 | 15 |
| | Shell | Styrene (88)/butadiene (10)/acrylic acid (2) | 40 | 67 | Crosslinked | | | |
| P-7 | Core | Styrene (63)/butadiene (37) | 50 | 0 | Crosslinked | 37.6 | 88 | 15 |
| | Shell | Styrene (75)/butyl methacrylate (22)/acrylic acid (3) | 50 | 79 | 76000 | | | |
| P-8 | Core | Styrene (63)/butadiene (37) | 50 | 0 | Crosslinked | 37.2 | 92 | 11 |
| | Shell | Styrene (80)/2-ethylhexyl acrylate (15)/acrylic acid (5) | 50 | 66 | 54000 | | | |
| P-9 | Core | Butyl acrylate (76)/2-ethylhexyl acrylate (22)/ethylene glycol diacrylate (2) | 40 | −41 | Crosslinked | 36.9 | 101 | −6 |
| | Shell | Styrene (82)/2-ethylhexyl acrylate (15)/acrylic acid (3) | 60 | 69 | 78000 | | | |
| P-10 | Core | Dodecyl acrylate (85)/2-ethylhexyl acrylate (13)/divinylbenzene (2) | 55 | −5 | Crosslinked | 37.2 | 99 | 12 |
| | Shell | Styrene (82)/2-ethylhexyl acrylate (10)/acrylic acid (3) | 45 | 74 | 56000 | | | |
| P-11 | Core | Butyl acrylate (84)/2-ethylhexyl acrylate (14)/acrylic acid (2) | 40 | −52 | 123000 | 35.5 | 93 | −11 |
| | Shell | Styrene (82)/2-ethylhexyl acrylate (15)/acrylic acid (3) | 60 | 69 | 78000 | | | |
| P-12 | Core | Styrene (67)/butadiene (33) | 50 | 9 | Crosslinked | 42.2 | 103 | 16 |
| | Shell | Styrene (92)/butadiene (5)/acrylic acid (3) | 50 | 84 | Crosslinked | | | |
| P-13 | Core | Styrene (51)/butadiene (49) | 50 | −21 | Crosslinked | 39.6 | 98 | 14 |
| | Shell | Styrene (96)/butadiene (1)/acrylic acid (3) | 50 | 98 | Crosslinked | | | |
| P-14 | Core | Styrene (52)/butadiene (48) | 50 | −20 | Crosslinked | 41.1 | 96 | 0 |
| | Shell | Styrene (85)/butadiene (12)/acrylic acid (3) | 50 | 61 | Crosslinked | | | |
| P-15 | Core | Styrene (51)/butadiene (49) | 30 | −21 | Crosslinked | 40.3 | 102 | −1 |
| | Shell | Styrene (85.5)/butadiene (11.5)/acrylic acid (3) | 70 | 62 | Crosslinked | | | |
| P-16 | Core | Styrene (67.5)/butadiene (32.5) | 50 | 10 | Crosslinked | 42.2 | 103 | 18 |
| | Shell | Styrene (96)/butadiene (1)/acrylic acid (3) | 50 | 98 | Crosslinked | | | |
| P-17 | Core | Styrene (52.5)/butadiene (47.5) | 50 | −19 | Crosslinked | 45.3 | 115 | −10 |
| | Shell | Styrene (80)/butadiene (17)/acrylic acid (3) | 50 | 47 | Crosslinked | | | |
| P-18 | Core | Styrene (62)/butadiene (38) | 50 | −2 | Crosslinked | 39.8 | 120 | 0 |
| | Shell | Styrene (80)/butadiene (17)/acrylic acid (3) | 50 | 47 | Crosslinked | | | |

TABLE 1-continued

| No. | Structure | | Core/shell ratio | Tg (° C.) | Molecular weight | Concentration (wt %) | Particle diameter (nm) | MFT (° C.) |
|---|---|---|---|---|---|---|---|---|
| P-19 | Core | Styrene (57)/butadiene (43) | 50 | −11 | Crosslinked | 39.6 | 86 | 7 |
| | Shell | Styrene (80)/butadiene (17)/acrylic acid (3) | 50 | 47 | Crosslinked | | | |
| P-20 | Core | Styrene (50.5)/butadiene (49.5) | 70 | −22 | Crosslinked | 35.9 | 99 | 2 |
| | Shell | Styrene (86)/butadiene (11)/acrylic acid (3) | 30 | 63 | Crosslinked | | | |
| P-21 | Core | Styrene (67.5)/butadiene (32.5) | 50 | 10 | Crosslinked | 37.7 | 105 | 5 |
| | Shell | Styrene (80)/butadiene (17)/acrylic acid (3) | 50 | 47 | Crosslinked | | | |
| P-22 | Core | Styrene (63.5)/butadiene (36.5) | 50 | 1 | Crosslinked | 40.6 | 109 | 8 |
| | Shell | Styrene (96.5)/butadiene (0.5)/acrylic acid (3) | 50 | 99 | Crosslinked | | | |
| P-23 | Core | Styrene (52)/butadiene (48) | 50 | −20 | Crosslinked | 41.8 | 120 | 5 |
| | Shell | Styrene (90.5)/butadiene (6.5)/acrylic acid (3) | 50 | 78 | Crosslinked | | | |
| P-24 | Core | Styrene (67.5)/butadiene (32.5) | 50 | 10 | Crosslinked | 44.1 | 99 | 10 |
| | Shell | Styrene (85.5) /butadiene (11.5)/acrylic acid (3) | 50 | 62 | Crosslinked | | | |
| P-25 | Core | Styrene (57)/butadiene (43) | 50 | −11 | Crosslinked | 38.6 | 100 | 3 |
| | Shell | Styrene (74)/butadiene (23)/acrylic acid (3) | 50 | 31 | Crosslinked | | | |
| P-26 | Core | Styrene (24)/butadiene (76) | 50 | −60 | Crosslinked | 41.2 | 104 | −26 |
| | Shell | Styrene (80)/butadiene (17)/acrylic acid (3) | 50 | 47 | Crosslinked | | | |

These polymers may be used by each alone, or two or more of them may be used in combination as reqired. It is also possible to use the above polymers together with other polymers.

The method for producing the dispersion of polymer microparticles having a core/shell structure, which is the binder of the image-forming layer, is not particularly limited so long as the method is one that can be used for the production of photographic materials.

The dispersion of polymer microparticles having a core/shell structure is preferably an aqueous dispersion, and examples thereof include "polymer emulsion", which is obtained by emulsion dispersion of a polymer solution in a water-immiscible solvent (e.g., ethyl acetate, perfluoroalkanes etc.) in an aqueous medium in the presence of surfactant, protective colloid or the like, "polymer latex", which is obtained by direct dispersion of polymer in an aqueous medium during the production of the polymer, and so forth. In particular, the latter latex is preferred as the dispersion of polymer microparticles having a core/shell structure used for the present invention, because it enables formation of fine microparticles, shows good dispersion stability, and requires less amount of surfactant used together. The particle size of the microparticles in the latex is usually 500 nm or less, preferably 300 nm or less, more preferably 200 nm or less.

Latex preferably used as the dispersion of polymer microparticles having a core/shell structure can be obtained by usual polymerization reactions such as emulsion polymerization, dispersion polymerization and suspension polymerization. However, in most cases, coating of photographic photosensitive materials is performed by using water as a medium, and non-water-soluble substances such as the aforementioned polymers are used in the form of aqueous dispersion. Therefore, in view of preparation of coating solution, emulsion polymerization or dispersion polymerization is preferred, and it is particularly preferably prepared by emulsion polymerization.

Emulsion polymerization can be performed by using water or a mixed solvent consisting of water and a water-miscible organic solvent (for example, methanol, ethanol, acetone etc.) as a dispersion medium, and allowing polymerization of monomer mixture in an amount of 5–40 weight % with respect to the dispersion medium at 30–100° C., preferably at 60–90° C., for 3 to 8 hours with stirring in the presence of a polymerization initiator and emulsifier in amounts of 0.05–5 weight % and 0.1–20 weight %, respectively, with respect to the monomers. Conditions including dispersion medium, concentrations of monomers, amount of initiator, amount of emulsifier, reaction temperature, time, addition methods of monomers and so forth can be optionally selected by considering the types of monomers to be used, intended particle size of the microparticles and so forth.

Examples of polymerization initiators preferably used for emulsion polymerization include inorganic peroxides such as potassium persulfate and ammonium persulfate, azonitrile compounds such as sodium salt of azobiscyanovaleric acid, azoamidine compounds such as 2,2'-azobis(2-amidinopropane) dihydrochloride, cyclic azoamidine compounds such as 2,2'-azobis[2-(5-methyl-2-imidazolin-2-yl) propane] hydrochloride, azoamide compounds such as 2,2'-azobis{2-methyl-N-[1,1'-bis(hydroxymethyl)-2-hydroxyethyl]propionamide}. Among these, potassium persulfate and ammonium persulfate are particularly preferred.

As the emulsifier, although any of anionic surfactants, nonionic surfactants, cationic surfactants and amphoteric surfactants can be used, anionic surfactants are preferred.

Latex preferably used as the dispersion of polymer microparticles having a core/shell structure can be readily prepared by usual procedure of emulsion polymerization. General procedures of emulsion polymerization are detailed in the following literature: "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); and Soichi Muroi, "Gosei Latex no Kagaku (Chemistry of Synthetic Latex)", Kobunshi Kanko Kai (1970).

The latex preferably used for the present invention may be of any type so long as it is a dispersion of polymer microparticles. The dispersed state may be emulsion dispersion, micelle dispersion, dispersion in which polymer molecules having a hydrophilic portion are dispersed in molecular state or the like. Among these, polymer dispersion prepared by emulsion polymerization is preferred.

As the organic solvent that can be used together with the medium of the polymer microparticle dispersion, water-miscible organic solvents are preferred. Examples thereof include, for example, alcohols such as methyl alcohol, ethyl alcohol and propyl alcohol, cellosolves such as methyl cellosolve, ethyl cellosolve and butyl cellosolve, ethyl acetate, dimethylformamide and so forth. The content of these solvents is preferably 50 weight % or less, more preferably 30 weight % or less, with respect to water. Preferred examples of the solvent composition are water alone, water/methyl alcohol =90/10, water/methyl alcohol= 70/30, water/methyl alcohol/dimethylformamide=80/15/5, water/methyl alcohol/ethyl cellosolve=85/10/5, water/methyl alcohol/isopropyl alcohol=85/10/5 and so forth (numerals indicate weight %).

The equilibrated moisture content of the binder polymer used for the present invention at 25° C. and relative humidity of 60% is preferably 2 weight % or less, more preferably 0.01–1.5 weight %, further preferably 0.02–1 weight %.

The "equilibrated moisture content at 25° C. and relative humidity of 60%" referred to herein is represented by the following equation, in which W1 indicates the weight of a polymer in humidity-conditioned equilibrium at 25° C. and relative humidity of 60%, and W0 indicates the absolute dry weight of the polymer at 25° C. Equilibrated moisture content at 25° C. and relative humidity of 60%=[(W1−W0)/W0]×100 (weight %)

For the details of the definition of moisture content and the method for measuring it, for example, Lecture of Polymer Engineering, 14, Test Methods for Polymer Materials (Polymer Society of Japan, Chijin Shokan) can be referred to.

In the present invention, the amount of the binder in the image-forming layer is preferably 0.2 to 30 g/m$^2$, more preferably 1 to 15 g/m$^2$. The weight ratio of total binder/organic silver salt is preferably 1/10–10/1, more preferably 1/5–4/1.

Such an image-forming layer is preferably also a photosensitive layer (emulsion layer) containing a photosensitive silver halide, which is a photosensitive silver salt. In such a case, the weight ratio of total binder/silver halide is preferably 400–5, more preferably 200-14 10.

The non-photosensitive silver salt of an organic acid used in the present invention is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Such non-photosensitive silver salts of an organic acid are disclosed in Japanese Patent Laid-open Publication (Kokai, hereinafter referred to as JP-A) 10-62899, paragraphs 0048 to 0049, EP0803763A1, page 18, line 24 to page 19, line 37, and EP962812A1. Silver salts of an organic acid, in particular, silver salts of a long chained aliphatic carboxylic acid having from 10 to 30, preferably from 15 to 28 carbon atoms, are preferred. Preferred examples of the silver salt of an organic acid include silver behenate, silver arachidinate, silver stearate, silver oleate, silver laurate, silver caproate, silver myristate, silver palmitate, mixtures thereof and so forth.

While the silver salt of an organic acid may be used in a desired amount, it is preferably used in an amount of 0.1–0.5 g/m$^2$, more preferably of 1–3 g/m$^2$, in terms of silver amount.

The shape of the silver salt of an organic acid that can be used for the present invention is not particularly limited. However, scaly silver salts of an organic acid are preferred for the present invention. Scaly silver salts of an organic acid are herein defined as follows. A sample of a silver salt of an organic acid is observed with an electronic microscope, and grain shapes of the salt are approximated to rectangular parallelepipeds. The three different edges of each rectangular parallelepiped are represented as a, b and c where a is the shortest, c is the longest, and c and b may be the same. From the shorter edges a and b, x is obtained according to the following equation:

$$x=b/a$$

The values of x are obtained for about 200 grains, and an average of them (x (average)) is obtained. Samples that satisfy the requirement of x (average)≧1.5 are defined to be scaly. Scaly grains preferably satisfy 30≧x (average)≧1.5, more preferably 20≧x (average)≧2.0. In this connection, acicular (needle-like) grains satisfy 1≦x (average)<1.5.

In scaly grains, it is understood that a corresponds to the thickness of tabular grains of which main planes are defined by the sides of b and c. The average of a is preferably from 0.01 μm to 0.23 μm, more preferably from 0.1 μm to 0.20 μm. The average of c/b is preferably from 1 to 6, more preferably from 1.05 to 4, even more preferably from 1.1 to 3, particularly preferably from 1.1 to 2.

The grain size of the silver salt of an organic acid (volume weight average diameter) can be determined by, for example, irradiating a solid microparticle dispersion of organic acid silver salt in a liquid with a laser ray and determining an autocorrelation function of the fluctuation of the scattered light on the basis of the change in time. The average grain size is preferably 0.05–10.0 μm, more preferably 0.1–5.0 μm, further preferably 0.1–2.0 μm.

The grain size distribution of the non-photosensitive silver salt of an organic acid is preferably monodispersion. The term "monodispersion" as used herein means that the percentage of the value obtained by dividing the standard deviation of the length of the short axis or long axis by the length of the short axis or long axis, respectively, is preferably 100% or less, more preferably 80% or less, further preferably 50% or less.

Another method for determining the dispesibility is a method of obtaining the standard deviation of a volume weight average diameter of the silver salt of an organic acid. The percentage of the value obtained by dividing the standard deviation by the volume weight average diameter (variation coefficient) is preferably 100% or less, more preferably 80% or less, further preferably 50% or less.

As the methods for the production and dispersion of the silver salt of an organic acid used for the present invention, known methods can be used. For example, JP-A-10-62899, EP0803763A1 and EP962812A1 can be referred to.

If a photosensitive silver salt is present during the dispersion of the non-photosensitive silver salt of an organic acid, fog will be increased and sensitivity is markedly lowered. Therefore, it is desirable that the non-photosensitive silver salt of an organic acid is dispersed substantially in the absence of a photosensitive silver salt. In the present invention, the amount of the photosensitive silver salt that may be in the aqueous dispersion of the non-photosensitive silver salt of an organic acid should be 0.1 mole % or less per mole of the silver salt of an organic acid, and the photosensitive silver salt is not added intentionally.

In the present invention, a photosensitive material can be produced by mixing a silver salt of an organic acid aqueous dispersion and a photosensitive silver salt aqueous dispersion. The mixing ratio of the silver salt of an organic acid and the photosensitive silver salt may be selected according to the purpose. However, the ratio of the photosensitive silver salt to the silver salt of an organic acid is preferably from 1 to 30 mole %, more preferably from 3 to 20 mole %, still more preferably from 5 to 15 mole %. In the mixing, two or more kinds of aqueous dispersions of silver salt of an organic acid are preferably mixed with two or more photosensitive silver salt aqueous dispersions in order to control the photographic properties.

The thermally processed image recording material of the present invention contains a reducing agent for silver ions. The reducing agent for silver ions is an arbitrary substance, preferably an organic substance, which reduces silver ions into metal silver. Specific examples of the reducing agent are described in JP-A-11-65021, paragraphs 0043 to 0045 and EP 0803764A1, from page 7, line 34 to page 18, line 12. In the present invention, bisphenol-type reducing agents such as 1,1-bis(2-hydroxy-3,5-dimethylphenyl)-3,5,5-trimethylhexane, 2,2'-methylenebis-(4-methyl-6-tert-butylphenol), 2,2'-methylenebis-(4-methyl-6-tert-butylphenol) are particularly preferred.

The amount of the reducing agent is preferably 0.01–3.0 $g/m^2$, more preferably 0.1–3.0 $mmol/m^2$. The amount is preferably 5–50 mole %, more preferably 10–40 mole %, per 1 mol of silver contained in the layers on the side having the image-forming layer.

The reducing agent may be added to a coating solution in any form such as solution, emulsion dispersion and solid microparticle dispersion so that it could be incorporated into the thermally processed image recording material.

As a well known emulsion dispersion method, there can be mentioned a method of dissolving the reducing agent in an oil such as dibutyl phthalate, tricresyl phosphate, glyceryl triacetate or diethyl phthalate by using an auxiliary solvent such as ethyl acetate or cyclohexanone and mechanically preparing an emulsion dispersion. As the method for preparing solid microparticle dispersion, there can be mentioned a method of dispersing powder of the reducing agent in a suitable solvent such as water by using a ball mill, colloid mill, vibrating ball mill, sand mill, jet mill, roller mill or ultrasonic wave to form solid dispersion. In this operation, a protective colloid (e.g., polyvinyl alcohol), surfactant (e.g., an anionic surfactant such as sodium triisopropylnaphthalenesulfonate (mixture of those having three isopropyl groups on different positions)) and so forth may be used.

The dispersion may contain a preservative (e.g., benzisothiazolinone sodium salt).

The thermally processed image recording material of the present invention preferably contains a photosensitive silver halide. The photosensitive silver halide that can be used for the present invention is not particularly limited as for the halogen composition, and silver chloride, silver chlorobromide, silver bromide, silver iodobromide, silver chloroiodobromide and so forth may be used. The halide composition may have a uniform distribution in the grains, or the compositions may change stepwise or continuously in the grains. Silver halide grains having a core/shell structure may be preferably used. Core/shell grains having preferably a double to quintuple structure, more preferably a double to quadruple structure may be used. A technique for localizing silver bromide on the surface of silver chloride or silver chlorobromide grains may also be preferably used.

For the preparation of the photosensitive silver halide, methods well known in the art, e.g., the methods described in Research Disclosure, No. 17029 (June, 1978) and U.S. Pat. No. 3,700,458, can be used. More specifically, a method can be used which comprises a step of preparing photosensitive silver halide grains by addition of a silver-supplying compound and a halogen-supplying compound to a solution of gelatin or other polymer, and then adding a silver salt of an organic acid to the resulting grains.

As for grain size of the photosensitive silver halide, smaller grains are desirable to prevent cloudiness of the photosensitive material after image formation. Specifically, the grain size may preferably be not greater than 0.20 $\mu$m, preferably from 0.01 to 0.15 $\mu$m, more preferably from 0.02 to 0.12 $\mu$m. The term "grain size" used herein means a diameter of a sphere having the same volume as the grain where the silver halide grains are regular crystals in cubic or octahedral form and where the silver halide grains are irregular crystals such as spherical or rod-like grains. Where silver halide grains are tabular grains, the term means the diameter of a circle having the same area as a projected area of the main surface of the tabular grain.

Examples of the form of silver halide grains include a cubic form, octahedral form, tabular form, spherical form, rod-like form and potato-like form. In particular, cubic grains are preferred for the present invention. Silver halide grains having round corners are also preferably used in the present invention. Surface index (Miller index) of outer surfaces of the photosensitive silver halide grains is not particularly limited. However, it is desirable that [100] face should be present in a high proportion that can achieve high spectral sensitizing efficiency when a spectral sensitizing dye adsorbed on the grains. The proportion of [100] face may be preferably not lower than 50%, more preferably at least 65%, still more preferably at least 80%. The proportion of Miller index [100] face can be determined using the method described in T. Tani, J. Imaging Sci. , 29, 165 (1985), where the difference in adsorption of a sensitizing dye to [111] face and [100] face is utilized.

The photosensitive silver halide grain preferably contains a metal or metal complex of Group VIII to Group X in the periodic table of elements (including Group I to Group XVIII). The metal or the center metal of the metal complex of Group VIII to X of the periodic table is preferably rhodium, rhenium, ruthenium, osmium or iridium. The metal complex may be used alone, or two or more complexes of the same or different metals may also be used in combination. The metal complex content is preferably from $1\times10^{-9}$ to $1\times10^{-3}$ mole per mole of silver. Such metal complexes are described in JP-A-11-65021, paragraphs 0018 to 0024.

In the present invention, an iridium compound is preferably contained in the silver halide grains. Examples of the iridium compound include hexachloroiridium, hexammineiridium, trioxalatoiridium, hexacyanoiridium and pentachloronitrosyl-iridium. The iridium compound is used after dissolving it in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble iridium, separate silver halide grains previously doped with iridium may be added and dissolved at the time of preparation of silver halide. The addition amount of the iridium compound is preferably $1\times10^{-8}$ to $1\times10^{-3}$ mole, more preferably $1\times10^{-7}$ to $5\times10^{-4}$ mole, per mole of silver halide.

Further, metals and metal complexes that can be contained in the silver halide grains used for the present invention (e.g., $[Fe(CN)_6]^{4-}$), desalting methods and chemical sensitization methods are described in JP-A-11-84574, paragraphs 0046 to 0050 and JP-A-11-65021, paragraphs 0025 to 0031.

The photosensitive silver halide grains are preferably subjected to chemical sensitization by sulfur sensitization, selenium sensitization or tellurium sensitization. Any known compounds are preferably used for such sulfur, selenium or tellurium sensitization, and for example, the compounds described in JP-A-7-128768 are usable for that purpose. In the present invention, especially favorable is tellurium sensitization. Tellurium sensitizers usable herein include, for example, diacyltellurides, bis(oxycarbonyl)tellurides, bis (carbamoyl)tellurides, diacyltellurides, bis(oxycarbonyl) ditellurides, bis (carbamoyl)ditellurides, compounds with P=Te bond, tellurocarboxylates, tellurosulfonates, compounds with P—Te bond, tellurocarbonyl compounds etc. For these, specifically mentioned are the compounds described in JP-A-11-65021, paragraph 0030. Particularly preferred are those disclosed in JP-A-5-313284 as the compounds of the general formulas (II), (III) and (IV).

The amount of the sulfur, selenium or tellurium sensitizer for use in the present invention varies depending on the type of the silver halide grains to be used, the condition for chemical ripening etc., but may fall generally between $10^{-8}$ and $10^{-2}$ mole, preferably between $10^{-7}$ and $10^{-3}$ mole or so, per mol of the silver halide. Although the conditions for the chemical sensitization are not particularly limited in the present invention, pH falls between 5 and 8, pAg falls between 6 and 11, preferably between 7 and 10, and temperature falls between 40 and 95° C., preferably between 44 and 70° C.

In the present invention, the chemical sensitization may be performed at any time so long as it is performed after the formation of the grains and before the coating. It may be performed after desalting and (1) before the spectral sensitization, (2) simultaneously with the spectral sensitization, (3) after the spectral sensitization, (4) immediately before the coating, or the like. It is particularly preferably performed after spectral sensitization.

In the thermally processed image recording material of the present invention, one kind of photosensitive silver halide emulsion may be used or two or more different emulsions (for example, those having different average grain sizes, different halogen compositions, different crystal habits or different chemical sensitization conditions) may be used in combination. By using plural photosensitive silver halides having different sensitivities, contrast can be controlled. Examples of the techniques concerning this respect include those mentioned in JP-A-57-119341, JP-A-53-106125, JP-A-47-3929, JP-A-48-55730, JP-A-46-5187, JP-A-50-73627, JP-A-57-150841 and so forth. Each emulsion may preferably have sensitivity difference of 0.2 log E or higher.

The amount of the photosensitive silver halide is preferably 0.03 to 0.6 g/m$^2$, more preferably 0.05 to 0.4 g/m$^2$, most preferably 0.1 to 0.4 g/m$^2$, as the amount of coated silver per 1 m$^2$ of a photosensitive material. The amount of the photosensitive silver halide per mole of the silver salt of an organic acid is preferably from 0.01 to 0.5 mole, more preferably from 0.02 to 0.3 mole, still more preferably from 0.03 to 0.25 mole.

Methods and conditions for mixing photosensitive silver halide and silver salt of an organic acid, which are prepared separately, are not particularly limited so long as the effect of the present invention can be attained satisfactorily. Examples thereof include, for example, a method of mixing silver halide grains and silver salt of an organic acid after completion of respective preparations by using a high-speed stirring machine, ball mill, sand mill, colloid mill, vibrating mill, homogenizer or the like, or a method of preparing a silver salt of an organic acid by mixing a photosensitive silver halide obtained separately at any time during the preparation of the silver salt of an organic acid.

Preferred addition time point for the silver halide into the coating solution for image-forming layer resides in a period of from 180 minutes before the coating to immediately before the coating, preferably 60 minutes to 10 seconds before the coating. However, the method and conditions for mixing are not particularly limited so long as the effect of the present invention can be attained satisfactorily. Specific examples of the mixing method include a method in which the mixing is performed in a tank designed so that a desired average residence time therein can be obtained, which residence time is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

As a sensitizing dye that can be used for the present invention, there can be advantageously selected those sensitizing dyes which can spectrally sensitize silver halide grains within a desired wavelength range after they are adsorbed by the silver halide grains and have spectral sensitivity suitable for spectral characteristics of the light source to be used for exposure. Such sensitizing dyes and addition methods therefor are described in JP-A-11-65021, paragraphs 0103 to 0109 and EP 0803764A1, page 19, line 38 to page 20, line 35, and there can be mentioned the compounds of formula (II) described in JP-A-10-186572. In the present invention, the sensitizing dye is preferably added to the silver halide emulsion during the period after the desalting step and before the coating step, more preferably during the period after the desalting step and before the start of the chemical ripening.

In the thermally processed image recording material of the present invention, the phenol derivatives represented by the formula (A) mentioned in Japanese Patent Application No. 11-73951 are preferably used as a development accelerator.

In the thermally processed image recording material of the present invention, an image-hardening agent, that is, so-called nucleating agent, can be used in order to obtain high contrast images. While type of the nucleating agent that can be used in the present invention is not particularly limited, examples thereof include all of the hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP741320A. Further, the hydrazine derivatives represented by the formula (H) mentioned in Japanese Patent Application No. 11-87297, specifically, the hydrazine derivatives mentioned in Tables 1–4 of the same, can also be preferably used. Furthermore, the substituted alkene derivatives, substituted isoxazole derivatives and acetal compounds represented by the formulas (1) to (3) mentioned in Japanese Patent Application No. 11-87297, more preferably the cyclic compounds represented by the formula (A) or (B) mentioned in the same, specifically Compounds 1–72 mentioned in Chem. 8 to Chem. 12 of the same, can also be used. In addition to these compounds, any of the compounds described in U.S. Pat. Nos. 5,545,515, 5,635,339, 5,654,130 and 5,686,228, International Patent Publication WO97/34196, and JP-A-11-119372, JP-A-11-109546, JP-A-11-119373, JP-A-11-133546, JP-A-11-95365 and JP-A-11-

95366 may also be used. Two or more of these nucleating agents may be used in combination.

The amount of the nucleating agent is $1\times10^{-6}$ mole to 1 mole, more preferably from $1\times10^{-5}$ mole to $5\times10^{-1}$ mole, further preferably from $2\times10^{-5}$ mole to $2\times10^{-1}$ mole, per mol of silver.

While the nucleating agent may be added to any layer on the image-forming layer side including the image-forming layer and the other layers, it is preferably added to the image-forming layer or a layer adjacent thereto.

The nucleating agent may be used after being dissolved in an appropriate organic solvent such as an alcohol (e.g., methanol, ethanol, propanol, fluorinated alcohol), a ketone (e.g., acetone, methyl ethyl ketone), dimethylformamide, dimethyl sulfoxide or methyl cellosolve. Further, it may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, the nucleating agent may be used by dispersing powder of the nucleating agent in a suitable solvent such as water using a ball mill, a colloid mill, or by means of ultrasonic wave according to a known method for solid dispersion.

In the present invention, a contrast accelerator may be used in combination with the above-described nucleating agent for the formation of an ultrahigh contrast image. For example, amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14 may be used.

When a nucleating agent is used in the thermally processed image recording material the present invention, an acid formed by hydration of diphosphorus pentoxide or a salt thereof is preferably used together with the nucleating agent. Examples of the acid formed by hydration of diphosphorus pentoxide or a salt thereof include metaphosphoric acid (salt), pyrophosphoric acid (salt), orthophosphoric acid (salt) triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof may be used in a desired amount depending on the desired performance including sensitivity and fog. However, it can preferably be used in an amount of 0.1–500 $mg/m^2$, more preferably 0.5–100 $mg/m^2$, in terms of coating amount per 1 $m^2$ of the thermally processed image recording material.

The acid formed by hydration of diphosphorus pentoxide or a salt thereof that can be preferably used in the present invention is added to the image-forming layer or a binder layer adjacent thereto in order to obtain the desired effect with a small amount of the acid or a salt thereof.

Formic acid and formic acid salts serve as a strongly fogging substance in a thermally processed image recording material containing a photosensitive silver halide and a binder. In the present invention, the thermally processed image recording material preferably contains formic acid or a formic acid salt on the side having the image-forming layer containing a photosensitive silver halide in an amount of 5 mmol or less, more preferably 1 mmol or less, per 1 mole of silver.

As antifoggants, stabilizers and stabilizer precursors that can be used for the present invention, there can be mentioned, for example, those mentioned in JP-A-10-62899, paragraph 0070 and EP 0803764A1, from page 20, line 57 to page 21, line 7. Antifoggants preferably used in the present invention are organic polyhalogenated compounds. Examples thereof include those mentioned in JP-A-11-65021, paragraphs 0111–0112. In particular, the polyhalogenated compounds represented by the general formula (II) mentioned in JP-A-10-339934 (specific examples are tribromomethylnaphthyl-sulfone, tribromomethylphenylsulfone, tribromemethyl(4-(2,4,6-trimethylphenylsulfonyl)phenyl)sulfone etc.) are preferred.

The antifoggant can be added to the thermally processed image recording material, for example, in the same manner as that for the reducing agent described above. The polyhalogenated compound is also preferably added as solid microparticle dispersion.

Other examples of the antifoggant include the mercury(II) salts described in JP-A-11-65021, paragraph 0113, and the benzoic acids described in the same, paragraph 0114.

The thermally processed image recording material of the present invention may contain an azolium salt as the antifoggant. Examples of the azolium salt include, for example, the compounds of the general formula (XI) described in JP-A-59-193447, the compounds described in JP-B-55-12581 and the compounds of the general formula (II) described in JP-A-60-153039. The azolium salt may be added to any site of the thermally processed image recording material, but is preferably added to a layer on the image-forming layer side, more preferably to the image-forming layer. The azolium salt may be added at any time during the preparation of the coating solution. When the azolium salt is added to the image-forming layer, it may be added at any time during the period of from the preparation of the silver salt of an organic acid to the preparation of the coating solution. However, the azolium salt is preferably added during the period after the preparation of the silver salt of an organic acid and immediately before the coating. The azolium salt may be added in any form such as powder, solution and microparticle dispersion. It may also be added as a solution that also contains other additives such as sensitizing dye, reducing agent and toning agent. In the present invention, the amount of the azolium salt to be added is not particularly limited, but it is preferably $1\times10^{-6}$ mole to 2 moles, more preferably $1\times10^{-3}$ mole to 0.5 mole, per mole of silver.

The thermally processed image recording material of the invention may optionally contain any of mercapto compounds, disulfide compounds and thione compounds in order to control development by retarding or accelerating it, or enhance spectral sensitization efficiency, or improve storage stability before and after development. Examples of those compounds include, for example, those described in JP-A-10-62899, paragraphs 0067 to 0069, those of the formula (I) mentioned in JP-A-10-186572 and those described in EP 0803764A1, page 20, lines 36 to 56. Among these, preferred are mercapto-substituted heteroaromatic compounds.

The thermally processed image recording material of the present invention is preferably added with a toning agent.

Examples of the toning agent are mentioned in JP-A-10-62899, paragraphs 0054 to 0055 and EP 0803764A1, page 21, lines 23 to 48. Preferred are phthalazinone, phthalazinone derivatives (e.g., 4-(1-naphthyl)phthalazinone, 6-chlorophthalazinone, 5,7-dimethoxyphthalazinone, 2,3-dihydro-1,4-phthalazinone and other derivatives) and metal salts thereof; combinations of phthalazinones and phthalic acid or derivatives thereof (e.g., phthalic acid, 4-methylphthalic acid, 4-nitrophthalic acid, tetrachlorophthalic anhydride etc.); phthalazines including phthalazine and phthalazine derivatives (e.g., 4-(1-naphthyl) phthalazine, 6-isopropylphthalazine, 6-tert-butylphthalazine, 6-chlorophthalazine, 5,7-dimethoxyphthalazine, 2,3-dihydrophthalazine and other derivatives) and metal salts thereof; combinations of phthalazines and phthalic acid or derivatives thereof (e.g., phthalic acid, 4-methylphthalic acid, 4-nitrophthalic acid, tetrachlorophthalic anhydride etc.). Particularly preferred are combinations of phthalazines and phthalic acid derivatives.

Plasticizers and lubricants that can be used for the image-forming layer of the thermally processed image recording material of the present invention are described in JP-A-11-65021, paragraph 0117.

In the present invention, for the image-forming layer, various types of dyes and pigments may be used to improve color tone, to prevent interference fringes generated during laser exposure, and to prevent irradiation. These techniques are detailed in International Patent Publication WO98/36322. Preferred dyes and pigments include, for example, anthraquinone dyes, azomethine dyes, indoaniline dyes, azo dyes, indanthrone pigments of anthraquinone type (e.g., C.I. Pigment Blue 60 etc.), phthalocyanine pigments (e.g., copper phthalocyanines such as C.I. Pigment Blue 15; metal-free phthalocyanines such as C.I. Pigment Blue 16), triarylcarbonyl pigments of printing lake pigment type, indigo, inorganic pigments (e.g., ultramarine, cobalt blue etc.). Any methods are employed to add these dyes and pigments such as addition as a solution, emulsion, or dispersion of solid microparticles, or addition of a polymer mordant mordanted with these. The amount of these compounds to be used may vary depending on intended absorbance. In general, the compounds may preferably be used in an amount of 1 $\mu$g to 1 g per $m^2$ of the thermally processed image recording material.

The image-forming layer of the thermally processed image recording material of the present invention may contain a polymer such as latex polymer not according to the present invention, gelatin, polyvinyl alcohol, methylcellulose and hydroxypropylcellulose, as required. The amount of the hydrophilic polymer is preferably 30 weight % or less, more preferably 20 weight % or less, of the total binder in the image-forming layer.

In the present invention, an antihalation layer may be provided in a distant position from a light source relative to the image-forming layer. The antihalation layer is described in JP-A-11-65021, paragraphs 0123 to 0124.

In the thermally processed image recording material of the present invention, a decoloring dye and a base precursor can be added to a non-photosensitive layer of the thermally processed image recording material so that the non-photosensitive layer can function as a filter layer or an antihalation layer. Thermally processed image recording materials generally have non-photosensitive layers in addition to the photosensitive layers. Depending on their positions, the non-photosensitive layers are classified into (1) a surface protective layer to be provided on a photosensitive layer (the distant side from the support); (2) an intermediate layer to be provided between two or more of photosensitive layers or between a photosensitive layer and a surface protective layer; (3) an undercoat layer to be provided between a photosensitive layer and a support; (4) a back layer to be provided on a side opposite to the photosensitive layer. The filter layer is provided in the photosensitive material as the layer (1) or (2). The antihalation layer is provided in the photosensitive material as the layer (3) or (4).

The decoloring dye and the base precursor are preferably added to the same non-photosensitive layer. However, they may also be added separately to adjacent two non-photosensitive layers. If desired, a barrier layer may be provided between the two non-photosensitive layers.

As methods to add a decoloring dye to a non-photosensitive layer, a method may be employed which comprises step of adding a solution, emulsion, solid microparticle dispersion of the dye, or adding the dye impregnated in a polymer to a coating solution for the non-photosensitive layer. The dye may also be added to the non-photosensitive layer by using a polymer mordant. These methods for addition are the same as those generally employed for the addition of dyes to ordinary thermally processed image recording materials. Polymer latexes used for preparation of the dye impregnated in a polymer are described in U.S. Pat. No. 4,199,363, German Patent Laid-open Nos. 25,141,274, 2,541,230, EP029104A and JP-B-53-41091. A method for emulsification by adding a dye to a solution in which a polymer is dissolved is described in International Patent Publication WO88/00723.

The amount of the decoloring dye may be determined depending on purpose of the use of the dye. In general, the dye is used in an amount to give an optical density (absorbance) of larger than 0.1 measured at an intended wavelength. The optical density is preferably 0.2 to 2. The amount of the dye to give such optical density may be generally from about 0.001 to about 1 g/$m^2$, particularly preferably from about 0.01 to about 0.2 g/$m^2$.

Decoloring of dyes in that manner can lower optical density of the material to 0.1 or less. Two or more different decoloring dyes may be used in the thermodecoloring type recording materials or photothermographic materials. Similarly, two or more different base precursors may be used in combination.

The thermally processed image recording material of the present invention may further contain antioxidant, stabilizer, plasticizer, UV absorber, coating aid, crosslinking agent and so forth. These various additives are added to the photosensitive layer or the non-photosensitive layer. As for these, WO98/36322, EP803764A1, JP-A-10-186567, JP-A-10-18568 and so forth can be referred to.

Supports that can be used in the present invention are described in JP-A-11-65021, paragraph 0134; usable surfactants are described in the same, paragraph 0133; usable solvents are described in the same, paragraph 0133; usable antistatic and electroconductive layers are described in the same, paragraph 0135; and usable methods for forming color images are described in the same, paragraph 0136.

Preferably used as a transparent support is a polyester film, in particular, polyethylene terephthalate film, subjected to a heat treatment in a temperature range of 130–185° C. in order to relax the internal distortion formed in the film during the biaxial stretching so that thermal shrinkage distortion occurring during the heat development could be eliminated. When the thermally processed image recording material is for medical use, the transparent support may be colored with blue dyes (e.g., Dye-1 described in Examples of JP-A-8-240877), or may be colorless. For the support, techniques for undercoating described in JP-A-11-84574 (utilizing water-soluble polyester), JP-A-10-186565 (utilizing styrene/butadiene copolymer), Japanese Patent Application No. 11-106881, paragraphs 0063–0080 (utilizing vinylidene chloride copolymer) and so forth are preferably used. As for antistatic layers and undercoating, techniques disclosed in JP-A-56-143430, JP-A-56-143431, JP-A-58-62646, JP-A-56-120519, JP-A-11-84573, paragraphs 0040–0051, U.S. Pat. No. 5,575,957, JP-A-11-223898, paragraphs 0078–0084 and so forth can also be used.

The thermally processed image recording material of the present invention is constituted by one or more layers on the support. When it is constituted with a monolayer, the layer must contain a silver salt of an organic acid, developing agent, and binder as well as desired additional materials such as silver halide, toning agent, coating aid and other auxiliary agents. When the layer is bilayer, the first image-forming layer (in general, the layer adjacent to the support) may contain a silver salt of an organic acid and silver halide, and the second layer or the both layers may contain several other ingredients. Another type of bilayer structure is also employable in which one layer is a single image-forming layer containing all necessary ingredients and the other layer is a protective top coat layer. Multicolor thermally processed image recording material may contain these two layers for each color, or may contain all necessary ingredients in a single layer as described in U.S. Pat. No. 4,708,928. As for multicolor thermally processed image recording material containing multiple dyes, each image-forming layer is kept individually by using a functional or non-functional barrier layer between the adjacent photosensitive layers as described in U.S. Pat. No. 4,460,681.

The thermally processed image recording material of the present invention is preferably a so-called single-sided photosensitive material comprising at least one photosensitive layer containing a silver halide emulsion on one side of support, and a back layer on the other side.

The thermally processed image recording material of the invention is preferably of a monosheet type. The monosheet type does not use any additional sheets such as image receiving materials, but can form images directly on the material itself.

The temperature for preparation of the coating solution for the image-forming layer may preferably be 30° C. to 65° C., more preferably 35° C. to 60° C., most preferably 35° C. to 55° C. The temperature of the coating solution for the image-forming layer immediately after the addition of the polymer latex may preferably be kept at 30° C. to 65° C. A reducing agent and a silver salt of an organic acid may preferably be mixed before the addition of polymer latex.

The fluid containing silver salt of organic acid or coating solution for the thermally image-forming layer is preferably a so-called thixotropic flow. Thixotropy means that viscosity of a fluid lowers with increase of shear rate. Any apparatus may be used for measurement of viscosity. For example, RFS Fluid Spectrometer from Rheometrics Far East Co., as Ltd. is preferably used, and the measurement is performed at 25° C. Viscosity of the fluid containing silver salt of organic acid or coating solution for the thermally image-forming layer is preferably 400 mPa·s to 100,000 mPa·s, more preferably 500 mPa·s to 20,000 mPa·s, at a shear rate of 0.1 $sec^{-1}$. The viscosity is preferably 1 mPa·s to 200 mPa·s, more preferably 5 mPa·s to 80 mPa·s, at a shear rate of 1000 $sec^{-1}$.

Various systems exhibiting thixotropic property are known and, for example, described in "Koza Rheology (Lecture on Rheology)", Kobunshi Kanko Kai; Muroi & Morino, "Polymer Latex", Kobunshi Knako Kai and so forth. A fluid is required to contain a large amount of fine solid microparticles to exhibit thixotropic property. For enhancing thixotropic property, it is effective that the fluid is added with a viscosity-increasing linear polymer, or fine solid microparticles to be contained have anisotropic shapes and an increased aspect ratio. Use of an alkaline viscosity-increasing agent or a surfactant is also effective for that purpose.

In the present invention, the surface protective layer may contain a matting agent for improving the transferability of the material. The matting agent may also be contained in a layer functioning as a surface protective layer, or in a layer near the outer surface. The matting agent is preferably contained in a surface protective layer and/or a layer functioning as a surface protective layer.

Matting agents are described in JP-A-11-65021, paragraphs 0126 to 0127. The matting agent is added in an amount of preferably 1 to 400 mg/m $^2$, more preferably 5 to 300 mg/$m^2$, as the amount per 1 $m^2$ of the recording material.

While the matting degree of the surface of the image-forming layer side is not particularly limited so long as the material is free from stardust defects, Beck's smoothness of the surface is preferably 30 seconds to 2000 seconds, more preferably 40 seconds to 1500 seconds.

The matting degree of the back surface is preferably falls 10 seconds to 1200 seconds, more preferably 20 seconds to 800 seconds, further preferably 40 seconds to 500 seconds as shown by the Beck's smoothness.

The back layers that can be used for the present invention are described in, for example, JP-A-11-65021, paragraphs 0128 to 0130.

In the present invention, a hardening agent may be added to the image-forming layer, protective layer, back layer, and other layers. As for the hardening agent, various methods are described in T. H. James, "THE THEORY OF THE PHOTOGRAPHIC PROCESS, FOURTH EDITION", Macmillan Publishing Co., Inc., 1977, pp. 77–87. Polyvalent metal ions described on page 78 of the above article, polyisocyanates described in U.S. Pat. No. 4,281,060 and JP-A-6-208193, epoxy compounds described in U.S. Pat. No. 4,791,042, vinylsulfone compounds described in JP-A-62-89048 and so forth may preferably be used.

The hardening agent is added to coating solutions for protective layers as a solution. Preferred addition time of the solution resides in a period of from 180 minutes before the coating to just before the coating, preferably 60 minutes to 10 seconds before the coating. The method and conditions for mixing are not particularly limited so long as the effect of the present invention can be obtained satisfactorily. Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

The thermally processed image recording material of the present invention may be provided with a surface protective layer, for example, to prevent adhesion of the image-forming layer. The surface protective layer is described in, for example, JP-A-11-65021, paragraphs 0119 to 0120.

In the present invention, the binder forming the surface protective layer is not particularly limited so long as it is a usual polymer material having film-forming property, and a water-soluble polymer or oil-soluble polymer in any form selected from aqueous solution, aqueous dispersion, solution in an organic solvent and so forth can be used. Examples of usable materials are also described in JP-A-11-65021. Preferred examples of water-soluble polymers include gelatin, polyvinyl alcohol (PVA) and so forth. Examples of polyvinyl alcohol include, for example, completely saponified PVA (e.g., PVA-105, available from Kraray Co., Ltd.), partially saponified PVA (e.g., PVA-205, available from Kraray Co., Ltd.), denatured polyvinyl alcohol (e.g., PVA-102, MP-203 available from Kraray Co., Ltd.) and so forth.

The application amount of the water-soluble binder for one surface protective layer is preferably 0.3 to 4.0 g/m$^2$, more preferably 0.3 to 2.0 g/m$^2$.

When the thermally processed image recording material of the present invention is used for, in particular, printing use is which dimensional change is critical, polymer latex is preferably used also in a protective layer or a back layer. Such latex is described in "Gosei Jushi Emulsion (Synthetic Resin Emulsion)", compiledby Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. Specific example thereof include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/styrene (8.6 weight %)/2-hydroxyethyl methacrylate (5.1 weight %)/acrylic acid (2.0 weight %) copolymer and so forth. As for the binder of the protective layer, there may be used the combination of polymer latex disclosed in Japanese Patent Application No. 11-6872, and techniques disclosed in Japanese Patent Application No. 11-143058, paragraphs 0021–0025, Japanese Patent Application No. 11-6872, paragraphs 0027–0028 and Japanese Patent Application No. 11-199626, paragraphs 0023–0041.

The coating methods for coating solutions of the layers used in the production of the thermally processed image recording material of the present invention are not particularly limited, and any coating method can be used. Specific examples thereof include various types of coating techniques, for example, extrusion coating, slide coating, curtain coating, dip coating, knife coating, flow coating, extrusion coating utilizing a hopper of the type described in U.S. Pat. No. 2,681,294 and so forth. Preferably used are extrusion coating and slide coating described in Stephen F. Kistler, Petert M. Schweizer, "LIQUID FILM COATING", published by CHAPMAN & HALL Co., Ltd., 1997, pp. 399–536, and particularly preferably used is the slide coating. An example of the shape of slide coater used for the slide coating is shown in FIG. 11b, 1, on page 427 of the aforementioned reference. If desired, two or more layers may be coated simultaneously, for example, according to the methods described from page 399 to page 536 of the aforementioned reference, or the methods described in U.S. Pat. No. 2,761,791 and British Patent No. 837,095.

The thermally processed image recording material of the present invention preferably has a film surface pH of 6.0 or less, more preferably 5.5 or less before heat development. While the lower limit is not particularly limited, it is normally around 3. For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. A method for measuring the film surface pH is described in Japanese Patent Application No. 11-87297, paragraph 0123.

Other techniques that can be used for the production of the thermally processed image recording material of the present invention are also described in EP803764A1, EP883022A1, WO98/36322, JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-125880, JP-A-11-129629, JP-A-11-133536, JP-A-11-133537, JP-A-11-133538, JP-A-11-133539, JP-A-11-133542 and JP-A-11-133543.

The thermally processed image recording material of the present invention may be developed in any manner. Usually, an imagewise exposed thermally processed image recording material is developed by heating. The development temperature is preferably 80° C. to 250° C., more preferably 100° C. to 140° C. The development time is preferably 1 to 180 seconds, more preferably 10 to 90 seconds, particularly preferably 10 to 40 seconds.

For thermal development for the material, preferred is a plate heater system. For heat development by the plate heater system, the method described in JP-A-11-133572 is preferred. The plate heater system described in this reference is a heat development apparatus wherein a thermally processed image recording material on which a latent image is formed is brought into contact with heating means in a heat development section to obtain a visible image. In this apparatus, the heating means comprises a plate heater, and a plurality of presser rollers are disposed facing to one surface of the plate heater. Heat development of the thermally processed image recording material is attained by passing the material between the presser rollers and the plate heater. The plate heater is preferably sectioned into 2 to 6 stages, and the temperature of the top stage is preferably kept lower by 1 to 10° C. or so than that of the others. Such a method is also described in JP-A-54-30032. Such a plate heater system can remove moisture and organic solvent contained in the thermally processed image recording material out of the material, and prevent deformation of the support of the thermally processed image recording material by rapidly heating the material.

The thermally processed image recording material of the present invention can be exposed in any manner. As light source of exposure, laser rays are preferred. As the laser used in the present invention, gas lasers ($Ar^+$, He—Ne), YAG lasers, dye lasers, semiconductor lasers and so forth are preferred. A combination of semiconductor laser and second harmonic generating device may also be used. Preferred are gas or semiconductor lasers for red to infrared emission.

Single mode lasers can be used for the laser rays, and the technique disclosed in JP-A-11-65021, paragraph 0140, can be used.

The laser output is preferably at least 1 mW, more preferably at least 10 mW. Even more preferred is high output of at least 40 mW. If desired, a plurality of lasers may be multiplexed. The diameter of laser ray may be in the range of 30 and 200 $\mu$m or so in terms of $1/e^2$ spot size of a Gaussian beam.

As an example of laser imager provided with a light exposure section and heat development section, Fuji Medical Dry Imager FM-DP L can be mentioned.

FM-DP L is explained in Fuji Medical Review, No. 8, pages 39–55, and those techniques can of course be used in laser imagers for the thermally processed image recording material of the present invention.

The thermally processed image recording material of the present invention forms a monochromatic image based on silver image, and is preferably used as a thermally processed image recording material for use in medical diagnosis, industrial photography, printing and COM. In such applications, the monochromatic images formed can of course be duplicated on duplicating films, MI-Dup, from Fuji Photo Film for medical diagnosis; and for printing, the images can be used as the mask for forming images on films for reverse images such as DO-175 and PDO-100 from Fuji Photo Film, or on offset printing plates.

EXAMPLES

The present invention will be specifically explained with reference to the following examples. The materials, regents, ratios, procedures and so forth shown in the following examples can be optionally changed so long as such change does not depart from the spirit of the present invention. Therefore, the scope of the present invention is not limited by the following examples.

Synthesis Example

Synthesis of Polymer Latex P-5

In an autoclave made of glass (TEM-V1000, Taiatsu Glass Kogyo Co., Ltd.), 94.5 g of styrene, 280 g of distilled water and 4 g of surfactant (Sandet BL, SANYO CHEMICAL INDUSTRIES, LTD.) were placed and stirred for 1 hour under a nitrogen flow. Then, the reaction vessel was sealed, added with 55.5 g of butadiene, and warmed to 60° C. The reaction mixture was added with 20 g of 5% aqueous solution of potassium persulfate and stirred for 10 hours. Then, the reaction mixture was added with 132 g of styrene, 15 g of butadiene and 3 g of acrylic acid, and further stirred for 10 hours to allow the reaction. After the reaction was completed, the temperature were lowered to room temperature, and the reaction mixture was added with 148 g of distilled water and stirred for 30 minutes to obtain latex as milky white liquid.

Example 1

Preparation of Polyethylene Terephthalate (PET) Support having Undercoat Layers (1) Preparation of PET Support Using terephthalic acid and ethylene glycol, polyethylene terephthalate (PET) having an intrinsic viscosity IV of 0.66 (measured in phenol/tetrachloroethane=6/4 (weight ratio) at 25° C.) was obtained in a conventional manner. The PET was pelletized, and the pellets were dried at 130° C. for 4 hours, melted at 300° C., extruded from a T-die, and quenched to prepare an unstretched film having such a thickness that the film thickness after thermal fixation should become 175 $\mu$m.

The film was stretched along the longitudinal direction by 3.3 times at 110° C. using rollers having different peripheral speeds and then stretched along the transverse direction by 4.5 times at 130° C. using a tenter. Thereafter, the film was subjected to thermal fixation at 240° C. for 20 seconds and relaxed by 4% along the transverse direction at the same temperature. Then, after chucks of the tenter were released, the both edges of the film were knurled, and the film was rolled up at 4.8 kg/cm$^2$ to provide a roll of PET support having a thickness of 175 $\mu$m.

(2) Surface corona discharging treatment

Using a solid state corona discharging treatment machine Model 6KVA manufactured by Piller Inc., both surfaces of the PET support obtained in the above (1) were treated at room temperature at 20 m/minute. In this case, from the read out values of the electric current and voltage, it was seen that the treatment of 0.375 kV·A·minute/m$^2$ was applied to the support. The treated frequency in this case was 9.6 kHz and the gap clearance between the electrode and the dielectric roll was 1.6 mm.

(3) Preparation of coating solutions for undercoat layers

| Formulation 1 (for undercoat layer on image-forming layer side) | |
|---|---|
| Pesresin A-515GB made by Takamatsu Yushi K.K. (30 weight % solution) | 234 g |
| Polyethylene glycol monononylphenyl ether (mean ethylene oxide number = 8.5, 10 weight % solution) | 21.5 g |
| MP-1000 made by Soken Kagaku K.K. (polymer microparticles, mean particle size: 0.4 $\mu$m) | 0.91 g |
| Distilled water | 744 ml |

| Formulation 2 (for 1st layer on back surface) | |
|---|---|
| Butadiene/styrene copolymer latex (solid content: 40 weight %, weight ratio of butadiene/styrene = 32/68) | 158 g |
| 2,4-Dichloro-6-hydroxy-S-triazine sodium salt (8 weight % aqueous solution) | 20 g |
| 1 weight % Aqueous solution of sodium laurylbenzenesulfonate | 10 ml |
| Distilled water | 854 ml |

| Formulation 3 (for 2nd layer on back surface side) | |
|---|---|
| $SnO_2$/SbO (weight ratio: 9/1, mean particle size: 0.038 $\mu$m, 17 weight % dispersion) | 84 g |
| Gelatin (10% aqueous solution) | 89.2 g |
| Metorose TC-5 made by Shin-Etsu Chemical Co., Ltd. (2% aqueous solution) | 8.6 g |
| MP-1000 (polymer microparticles) made by Soken Kagaku K.K. | 0.01 g |
| 1 weight % Aqueous solution of sodium dodecylbenzenesulfonate | 10 ml |
| NaOH (1%) | 6 ml |
| Proxel (made by ICI Co.) | 1 ml |
| Distilled water | 805 ml |

(4) Preparation of PET support having undercoat layers

On one surface of the PET support subjected to the corona discharging treatment in the above (2), the undercoating solution of Formulation 1 obtained in the above (3) was coated by a wire bar in a wet coating amount of 6.6 ml/m$^2$ and dried at 180° C. for 5 minutes. Then, the back surface thereof was coated with the undercoating solution of Formulation 2 by a wire bar in a wet coating amount of 5.7 ml/m$^2$ and dried at 180° C. for 5 minutes. The back surface thus coated was further coated with the undercoating solution of Formulation 3 by a wire bar in a wet coating amount of 7.7 ml/m$^2$ and dried at 180° C. for 6 minutes to prepare a PET support having undercoat layers.

Preparation of coating solution for back surface (1) Preparation of coating solution for antihalation layer (1-1) Preparation of solid microparticle dispersion of base precursor 64 g of Base precursor compound 11, 28 g of diphenylsulfone and 10 g of surface active agent, Demor N (manufactured by Kao Corporation), were mixed with 220 ml of distilled water, and the mixture was beads-dispersed using a sand mill (¼ Gallon Sand Grinder Mill, manufactured by Imex Co.) to obtain solid microparticle dispersion of the base precursor compound having a mean particle size of 0.2 μm.

(1-2) Preparation of dye Solid microparticle dispersion 9.6 g of Cyanine dye compound 13 and 5.8 g of sodium p-dodecylbenzenesulfonate were mixed with 305 ml of distilled water, and the mixture was beads-dispersed using a sand mill (¼ Gallon Sand Grinder Mill, manufactured by Imex Co.) to obtain a dye solid microparticle dispersion having a mean particle size of 0.2 μm.

(1-3) Preparation of coating solution for antihalation layer 17 g of gelatin, 9.6 g of polyacrylamide, 70 g of the solid microparticle dispersion of the base precursor obtained in the above (1), 56 g of the dye solid microparticle dispersion obtained in the above (2), 1.5 g of polymethyl methacrylate microparticles (mean particle size 6.5 μm), 0.03 g of benzoisothiazolinone, 2.2 g of sodium polyethylenesulfonate, 0.2 g of Blue dye compound 14 and 844 ml of water were mixed to prepare a coating solution for antihalation layer.

(2) Preparation of coating solution for back surface protective Layer

In a container kept at 40° C., 50 g of gelatin, 0.2 g of sodium polystyrenesulfonate, 2.4 g of N,N-ethylenebis (vinyl-sulfonacetamide), 1 g of sodium tert-octylphenoxyethoxy-ethanesulfonate, 30 mg of benzoisothiazolinone, 37 mg of N-perfluorooctylsulfonyl-N-propylalanine potassium salt, 0.15 g of polyethylene glycol mono(N-perfluorooctylsulfonyl-N-propyl-2-aminoethyl) ether [average polymerization degree of ethylene oxide: 15], 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization ratio (by weight): 5/95) as polymer latex, 0.6 g of Aerosol OT (manufactured by American Cyanamid Company), 1.8 g (as liquid paraffin) of a liquid paraffin emulsion and 950 ml of water were mixed to form a coating solution for back surface protective layer.

Preparation of coating solution for image-forming layer

Preparation of mixed emulsion of silver halide (1) Preparation of Silver Halide Emulsion 1

In a titanium-coated stainless steel reaction vessel, 1421 ml of distilled water, 3.1 ml of 1 weight % potassium bromide solution, 3.5 ml of 0.5 mol/L sulfuric acid and 31.7 g of phthalized gelatin were added and maintained at 34° C. with stirring. Separately, Solution A was prepared by adding distilled water to 22.22 g of silver nitrate to dilute it to 95.4 ml, and Solution B was prepared by diluting 26.3 g of potassium bromide with distilled water to a volume of 161 ml. To the aforementioned mixture in the titanium-coated stainless steel reaction vessel, the whole volume of Solution A and Solution B was added over 45 seconds at constant flow rates. Then, the mixture was added with 10 ml of 3.5 weight % aqueous hydrogen peroxide solution, and further added with 10.8 ml of a 10 weight % aqueous solution of benzimidazole. Separately, Solution C was prepared by adding distilled water to 51.86 g of silver nitrate to dilute it to 317.5 ml, and Solution D was prepared by diluting 45.8 g of potassium bromide with distilled water to a volume of 400 ml. The whole volume of Solution C was added to the above mixture over 20 minutes at a constant flow rate. Solution D was added by the control double jet method while pAg was maintained at 8.1.Hexachloroiridic acid (III) potassium salt in an amount of $1\times10^{-4}$ mole per mole of silver was added 10 minutes after the addition of Solutions C and D was started. Further, an aqueous solution of potassium iron(II) hexacyanide in an amount of $3\times10^{-4}$ mole per mole of silver was added 5 seconds after the addition of Solution C was completed. Then, the mixture was adjusted to pH 3.8 using 1 N sulfuric acid, and the stirring was stopped. Then, the mixture was subjected to precipitation, desalting and washing with water, adjusted to pH 5.9 and pAg of 8.0 with 1N sodium hydroxide to form silver halide dispersion.

The obtained silver halide dispersion was added with 5 ml of a 0.34 weight % methanol solution of 1,2-benzisothiazolin-3-one with stirring at 38° C., and after 40 minutes since then, added with a methanol solution of Spectral sensitizing dye A in an amount of $1\times10^{-3}$ mole per mole of silver. After 1 minutes, the mixture was warmed to 47° C., and 20 minutes after the warming, added with $7.6\times10^{-5}$ mole of sodium benzenethiosulfonate per mole of silver as a methanol solution. Further after 5 minutes, the mixture was added with Tellurium sensitizer B as a methanol solution in an amount of $1.9\times10^{-4}$ mole per mole of silver followed by ripening for 91 minutes. The mixture was added with 1.3 ml of a 0.8 weight % methanol solution of N,N'-dihydroxy-N"-diethylmelamine, and 4 minutes later, added with 5-methyl-2-mercaptobenzimidazole in an amount of $3.7\times10^{-3}$ mole per mole of silver and 1-phenyl-2-heptyl-5-mercapto-1,3,4-triazole as a methanol solution in an amount of $4.9\times10^{-3}$ mole per mole of silver to prepare Silver halide emulsion 1.

The grains in the obtained Silver halide emulsion 1 were pure silver bromide grains having a mean diameter as spheres of 0.046 μm and a variation coefficient of 20% for mean diameter as spheres. The grain size and others were obtained from averages for 1000 grains by using an electron microscope. The [100] face ratio of these grains was determined to be 80% by the Kubelka-Munk method.

(2) Preparation of Silver Halide Emulsion 2

Silver halide emulsion 2 was prepared in the same manner as the preparation of Silver halide emulsion 1 in the above (1) except that the liquid temperature during the formation of the grains was changed from 34° C. to 49° C., addition time of Solution C was changed to 30 minutes, potassium iron (II) hexacyanide was not used, and the amounts of Spectral sensitizing dye A, Tellurium sensitizer B and 1-phenyl-2-heptyl-5-mercapto-1,3,4-triazole were changed to $7.5\times10^{-4}$ mole, $1.1\times10^{-4}$ mole and $3.3\times10^{-3}$ mole per mole of silver, respectively. The grains in the obtained Silver halide emulsion 2 were pure silver bromide cubic grains having a mean grain size of 0.080 μm as spheres and a variation coefficient of 20% for diameter as spheres.

(3) Preparation of silver halide emulsion 3

Silver halide emulsion 3 was prepared in the same manner as the preparation of Silver halide emulsion 1 in the above (1) except that the liquid temperature during the formation of the grains was changed from 34° C. to 27° C., and the amounts of solid dispersion (gelatin aqueous solution) of Spectral sensitizing dye A and Tellurium sensitizer B were changed to $6\times10^{-3}$ mole and $5.2\times10^{-4}$ mole per mole of silver, respectively. The grains in the obtained Silver halide emulsion 3 were pure silver bromide cubic grains having a mean grain size of 0.038 μm as spheres and a variation coefficient of 20% for diameter as spheres.

(4) Preparation of mixed emulsion of silver halide

70% by weight of Silver halide emulsion 1, 15% by weight of Silver halide emulsion 2 and 15% by weight of Silver halide emulsion 3, which were obtained in the above (1) to (3), were mixed and added with benzothiazolium iodide in an amount of $7\times10^{-3}$ mole per mole of silver as a 1 weight % aqueous solution to form a mixed emulsion of silver halide.

<Preparation of organic acid silver salt dispersion>

87.6 g of behenic acid (Edenor C22-85R, trade name, manufactured by Henkel Co.), 423 ml of distilled water, 49.2 ml of 5N aqueous solution of NaOH, and 120 ml of tert-butanol were mixed and allowed to react at 75° C. for one hour with stirring to obtain a solution of sodium behenate. Separately, 206.2 ml of an aqueous solution containing 40.4 g of silver nitrate (pH 4.0) was prepared and kept at 10° C. A mixture of 635 ml of distilled water and 30 ml of tert-butanol contained in a reaction vessel kept at 30° C. was added with the whole amount of the aforementioned sodium behenate solution and the whole amount of the aqueous silver nitrate solution at constant flow rates over the periods of 62 minutes and 10 seconds, and 60 minutes, respectively. In this case, they were added in such a manner that only the aqueous silver nitrate solution was added for 7 minutes and 20 seconds after starting the addition of the aqueous silver nitrate solution. Then, the addition of the sodium behenate solution was started so that only the sodium behenate solution could be added for 9 minutes and 30 seconds after finishing the addition of the aqueous silver nitrate solution. In this operation, the outside temperature was controlled so that the temperature in the reaction vessel could be 30° C. and the liquid temperature should be constant. The piping of the addition system for the sodium behenate solution was warmed by steam trace and the steam opening was controlled such that the liquid temperature at the outlet orifice of the addition nozzle should be 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled to be at heights for not contacting with the reaction mixture.

After finishing the addition of the sodium behenate solution, the mixture was left with stirring for 20 minutes at the same temperature and then the temperature was decreased to 25° C. Thereafter, the solid content was separated by suction filtration and washed with water until electric conductivity of the filtrate became 30 $\mu$S/cm. Thus, a silver salt of an organic acid was obtained. The obtained solid content was stored as a wet cake without being dried.

When the shape of the obtained silver behenate grains was evaluated by an electron microscopic photography, the grains were scaly crystals having a=0.14 $\mu$m, b=0.4 $\mu$m, and c=0.6 $\mu$m in mean values, a mean aspect ratio of 5.2, a mean diameter as spheres of 0.52 $\mu$m, and a variation coefficient of 15% for mean diameter as spheres (a, b and c have the meanings defined in the present specification).

To the wet cake corresponding to 100 g of the dry solid content was added with 7.4 g of polyvinyl alcohol (PVA-217, trade name) and water to make the total amount 385 g, and the mixture was pre-dispersed by a homomixer.

Then, the pre-dispersed stock dispersion was treated three times by using a dispersing machine (Microfluidizer-M-110S-EH; trade name, manufactured by Microfluidex International Corporation, using G10Z interaction chamber) with a pressure controlled to be 1750 kg/cm$^2$ to obtain a silver behenate dispersion. As for the cooling operation, a dispersion temperature of 18° C. was achieved by providing coiled heat exchangers fixed before and after the interaction chamber and controlling the temperature of the refrigerant.

Preparation of 25 weight % dispersion of reducing agent 10 kg of 1,1-bis(2-hydroxy-3,5-dimethylphenyl)-3,5,5-trimethylhexane, 10 kg of a 20 weight % aqueous solution of denatured polyvinyl alcohol (Poval MP203, manufactured by Kuraray Co. Ltd.) and 16 kg of water were mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 0.2 g of benzothiazolinone sodium salt and water so that the concentration of the reducing agent could become 25% by weight to obtain 25 weight % dispersion of reducing agent. The reducing agent particles contained in the dispersion had a median diameter of 0.42 $\mu$m and the maximum particle size of 2.0 $\mu$m or less. The obtained reducing agent dispersion was filtered through a polypropylene filter having a pore size of 10.0 $\mu$m to remove dusts and so forth, and stored.

Preparation of 10 weight % dispersion of mercapto compound 5 kg of 1-phenyl-2-heptyl-5-mercapto-1,3,4-triazole, 5 kg of a 20 weight % aqueous solution of denatured polyvinyl alcohol (Poval MP203, manufactured by Kuraray Co., Ltd.) and 8.3 kg of water were mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 6 hours. Then, the slurry was added with water so that the concentration of the mercapto compound could become 10 weight % to obtain a mercapto compound dispersion. The mercapto compound particles contained in the dispersion had a median diameter of 0.40 $\mu$m and the maximum particle size of 2.0 $\mu$m or less. The obtained mercapto compound dispersion was filtered through a polypropylene filter having a pore size of 10.0 $\mu$m to remove dusts and so forth, and stored. The dispersion was filtered through a polypropylene filter having a pore size of 10.0 $\mu$m immediately before use.

Preparation of organic polyhalogenated compound dispersion 1

5 kg of tribromomethylnaphthylsulfone, 2.5 kg of a 20 weight % aqueous solution of denatured polyvinyl alcohol (Poval MP203, manufactured by Kuraray Co., Ltd.) and 213 g of 20 weight % aqueous solution of sodium triisopropylnaphthalene-sulfonate and 10 kg of water were mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 5 hours. Then, the slurry was added with 0.2 g of benzisothiazolinone sodium salt and water so that the concentration of the organic polyhalogenated compound could become 20 weight % to obtain Organic polyhalogenated compound dispersion 1. The organic polyhalogenated compound particles contained in the dispersion had a median diameter of 0.36 $\mu$m and the maximum particle size of 2.0 $\mu$m or less. The obtained Organic polyhalogenated compound dispersion 1 was filtered through a polypropylene filter having a pore size of 3.0 $\mu$m to remove dusts and so forth, and stored.

Preparation of organic polyhalogenated compound dispersion 2

A dispersion was prepared in the same manner as the above preparation of Organic polyhalogenated compound dispersion 1 except that 5 kg of tribromomethyl(4-(2,4,6-trimethylphenyl-sulfonyl)sulfone was used instead of 5 kg of tribromomethylnaphthylsulfone, and diluted so that the concentration of the organic polyhalogenated compound could become 25 weight % to obtain Organic polyhalogenated compound dispersion 2. The organic polyhalogenated compound particles contained in the dispersion had a median diameter of 0.38 μm and the maximum particle size of 2.0 μm or less. The obtained Organic polyhalogenated compound dispersion 2 was filtered in the same manner as Organic polyhalogenated compound dispersion 1, and stored.

Preparation of organic polyhalogenated compound dispersion 3

A dispersion was prepared in the same manner as the above preparation of Organic polyhalogenated compound dispersion 1 except that 5 kg of tribromomethylphenylsulfone was used instead of 5 kg of tribromomethylnaphthylsulfone and the amount of the 20 weight % aqueous solution of MP203 was changed to 5 kg, diluted so that the concentration of the organic polyhalogenated compound could become 30 weight % to obtain Organic polyhalogenated compound dispersion 3. The organic polyhalogenated compound particles in the dispersion had a median diameter of 0.41 μm and the maximum particle size of 2.0 μm or less. The obtained Organic polyhalogenated compound dispersion 3 was filtered in the same manner as Organic polyhalogenated compound dispersion 1, and stored. The dispersion was stored at 10° C. or less until use.

Preparation of 5 weight % solution of phthalazine compound 8 kg of denatured polyvinyl alcohol (MP-203, manufactured by Kuraray Co., Ltd.) was dissolved in 174.57 kg of water and then added with 3.15 kg of 20 weight % aqueous solution of sodium triisopropylnaphthalenesulfonate and 14.28 kg of 70 weight % aqueous solution of 6-isopropylphthalazine to obtain a 5 weight % solution of 6-isopropylphthalazine.

Preparation of 20 weight % dispersion of pigment 64 g of C.I. Pigment Blue 60 and 6.4 g of Demor N manufactured by Kao Corporation, and 250 g of water were mixed sufficiently to provide slurry. Then, 800 g of zirconia beads having a mean diameter of 0.5 mm were placed in a vessel together with the slurry and the slurry was dispersed by a dispersing machine (¼ G Sand Grinder Mill; manufactured by Imex Co.) for 25 hours to obtain a 20 weight % pigment dispersion. The pigment particles contained in the obtained dispersion had a mean particle size of 0.21 μm.

Preparation of 40 weight % aqueous solution of SBR latex

The SBR latex mentioned below diluted by 10 times with distilled water was diluted and purified by using an UF-purification module FS03-FC-FUYO3A1 (manufactured by Daisen Membrane System K.K.) until the ion conductivity became 1.5 mS/cm, and added with Sandet-BL (manufactured by SANYO CHEMICAL INDUSTRIES, LTD.) to a concentration of 0.22 weight %. Further, the latex was added with NaOH and $NH_4OH$ so that the ratio of $Na^+$ ion:$NH_4^+$ ion could become 1:2.3 (molar ratio) to adjust pH to 8.4 to form a 40 weight % aqueous solution of SBR latex. (SBR latex: a latex of -St(68)-Bu(29)-AA(3)-, wherein the numerals in the parentheses indicate the contents in terms of % by weight, St represents styrene, Bu represents butadiene and AA represents acrylic acid)

The latex had the following characteristics: mean particle size of 0.1 μm, concentration of 45%, equilibrated moisture content of 0.6 weight % at 25° C. and relative humidity 60%, and ion conductivity of 4.2 mS/cm (measured for the latex stock solution (40%) at 25° C. by using a conductometer, CM-30S, manufactured by Toa Electronics, Ltd.), pH 8.2.

Preparation of coating solution for image-forming layer 10 g of the mixed emulsion of silver halide, 103 g of the organic acid silver salt dispersion, 25 g of the 25 weight % aqueous solution of reducing agent, 6.2 g of the 10 weight % dispersion of mercapto compound, 16.3 g of Organic polyhalogenated compound dispersions 1 to 3 (weight ratio= 15:1:3), 18 ml of the 5 weight % solution of phthalazine compound, 1.1 g of the 20 weight % aqueous dispersion of pigment, 106 g of the 40 weight % aqueous solution of SBR latex, which were obtained above, and 5 g of 20 weight % of aqueous solution of polyvinyl alcohol PVA-205 (Kraray Co., Ltd.) were mixed sufficiently to prepare a coating solution for image-forming layer. The coating solution was fed as it was to a coating die in such a feeding amount giving a coating amount of 70 ml/$m^2$ and coated.

The viscosity of the obtained coating solution for emulsion layer was measured by a B-type viscometer manufactured by Tokyo Keiki K.K. and found to be 85 [mPa·s] at 40° C. (Rotor No. 1, 60 rpm).

The viscosity of the coating solution was measured at 25° C. by an RFS fluid spectrometer produced by Rheometric Far East Co., Ltd., and found to be 1500, 220, 70, 40 and 20 [mPa·s] at shear rates of 0.1, 1, 10, 100 and 1000 [1/second], respectively.

Preparation of coating solution for intermediate layer on image-forming layer side 772 g of a 10 weight % aqueous solution of polyvinyl alcohol, PVA-205 (manufactured by Kuraray Co., Ltd.), 5.3 g of the 20 weight % dispersion of pigment, 226 g of 27.5 weight % solution of methyl methacrylate/styrene/butyl acrylate/hydroxyethyl methacrylate/acrylic acid copolymer (copolymerization ratio (by weight): 64/9/20/5/2) latex, 2 ml of a 5 weight % aqueous solution of Aerosol OT (manufactured by American Cyanamid Company), 10.5 ml of a 20 weight % aqueous solution of phthalic acid diammonium salt and water in such an amount giving a total amount of 880 g were mixed to form a coating solution for intermediate layer. This coating solution was fed to a coating die in such an amount that gave a coating amount of 10 ml/$m^2$. The viscosity of the fed coating solution measured by a B-type viscometer at 40° C. (Rotor No. 1, 60 rpm) was 21 [mPa·s].

Preparation of coating solution for 1st protective layer on image-forming layer side 64 g of inert gelatin was dissolved in water, added with 80 g of a 27.5 weight % latex solution of methyl methacrylate/styrene/butyl acrylate/hydroxyethyl methacrylate/acrylic acid copolymer (copolymerization ratio (by weight): 64/9/20/5/2), 23 ml of a 10 weight % methanol solution of phthalic acid, 23 ml of a 10 weight % aqueous solution of 4-methylphthalic acid, 28 ml of 1N sulfuric acid, 5 ml of a 5 weight % aqueous solution of Aerosol OT (manufactured by American Cyanamid Company), 0.5 g of phenoxyethanol, 0.1 g of benzoisothiazolinone, and water in such an amount that gave a total amount of 750 g to form a coating solution for first protective layer. The coating solution was mixed with 26 ml of 4 weight % chromium alum by a static mixer immediately before coating, and fed to a coating die in such an amount that gave a coating amount of 18.6 ml/$m^2$. The viscosity of the fed coating solution measured by a B-type viscometer (Rotor No. 1, 60 rpm) at 40° C. was 17 [mPa·s].

Preparation of coating solution for 2nd protective layer on image-forming layer side 80 g of inert gelatin was dissolved in water, added with 102 g of a 27.5 weight % latex solution of methyl methacrylate/styrene/butyl acrylate/hydroxyethyl methacrylate/acrylic acid copolymer (copolymerization ratio (by weight): 64/9/20/5/2), 3.2 ml of a 5 weight % solution of N-perfluorooctylsulfonyl-N-propylalanine potassium salt, 32 ml of a 2 weight % aqueous solution of polyethylene glycol mono (N-perfluorooctylsulfonyl-N-propyl-2-aminoethyl) ether [average polymerization degree of ethylene oxide=15], 23 ml of a 5 weight % aqueous solution of Aerosol OT (manufactured by American Cyanamid Company), 4 g of polymethyl methacrylate microparticles (mean particle size: 0.7 μm), 21 g of polymethyl methacrylate microparticles (mean particle size: 6.4 μm), 1.6 g of 4-methylphthalic acid, 4.8 g of phthalic acid, 44 ml of 1N sulfuric acid, 10 mg of benzoisothiazolinone and water in such an amount that gave a total amount of 650 g were mixed to form a coating solution for second protective layer. The coating solution was further mixed with 445 ml of an aqueous solution containing 4 weight % chromium alum and 0.67 weight % of phthalic acid by a static mixer immediately before coating, and fed to a coating die in such an amount that gave a coating amount of 8.3 ml/$m^2$.

The viscosity of the coating solution for second protective layer measured by a B-type viscometer (Rotor No. 1, 60 rpm) at 40° C. was 9 [mPa·s].

<<Preparation of thermally processed image recording materials>>

On the back surface side of the PET support having undercoat layers prepared above, the coating solution for antihalation layer and the coating solution for back surface protective layer were simultaneously applied as stacked layers so that the applied solid content amount of the solid microparticle dye in the antihalation layer could be 0.04 g/$m^2$, and the applied amount of gelatin in the protective layer should be 1.7 g/$m^2$, and dried to form an antihalation back layer.

Then, on the side opposite to the back side, the coating solution of image-forming layer (coated silver amount of the silver halide was 0.14 g/$m^2$), coating solution for intermediate layer on the image-forming layer side, coating solution for first protective layer on the image-forming layer side, and coating solution for second protective layer on the image-forming layer side were simultaneously applied in this order from the undercoat layer by the slide bead application method as stacked layers to form Sample 101 of the thermally processed image recording material.

The coating was performed at a speed of 160 m/min. The gap between the tip of coating die and the support was set to be 0.14 to 0.28 mm, and the coated width was controlled so that it could spread by 0.5 mm each at both sides compared with the projecting slit width of the coating solution. The pressure in the reduced pressure chamber was adjusted to be lower than the atmospheric pressure by 392 Pa. In this case, handling, temperature and humidity were controlled so that the support could not be electrostatically charged, and electrostatic charge was further eliminated by ionized wind immediately before the coating. In the subsequent chilling zone, the material was blown with air showing a dry-bulb temperature of 18° C. and a wet-bulb temperature of 12° C. for 30 seconds to cool the coating solutions. Then, in a floating type drying zone in a coiled shape, the material was blown with drying air showing a dry-bulb temperature of 30° C. and a wet-bulb temperature of 18° C. for 200 seconds. Subsequently, the material was passed through a drying zone of 70° C. for 20 seconds, and then another drying zone of 90° C. for 10 seconds, and cooled to 25° C. to evaporate the solvent in the coating solutions. The average wind velocity of the wind applied to the coated layer surface in the chilling zone and the drying zones was 7 m/sec.

The prepared thermally processed image recording material showed matting degrees of 550 seconds for the image-forming layer side, and 130 seconds for the back surface, in terms of Beck's smoothness.

Structures of the compounds used in this example are shown below.

Spectral sensitizing dye A

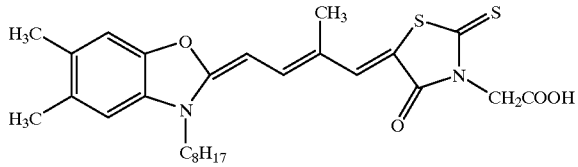

Tellurium sensitizer B

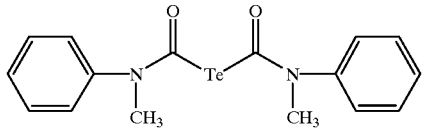

Base precursor compound 11

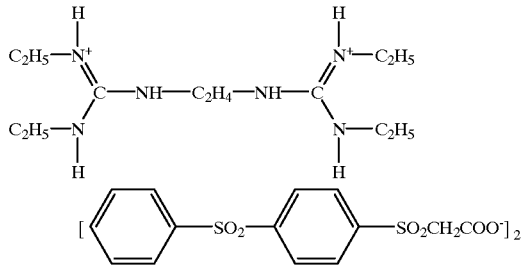

Cyanine dye compound 13

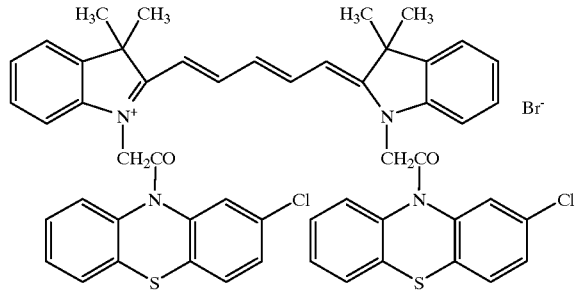

Blue dye compound 14

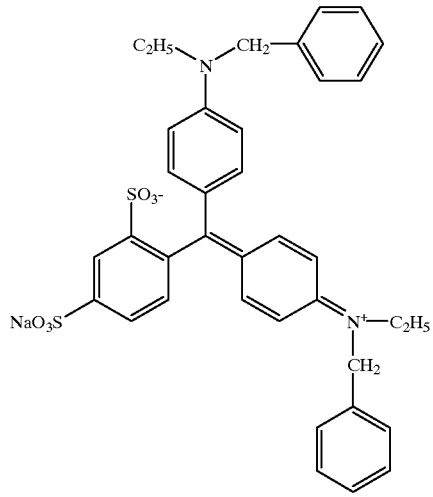

In the same manner as that for the sample obtained as described above (Sample 101) samples in which the composition of styrene and butadiene in the SBR latex were changed (Samples 102 and 103) and samples in which latexes having a core/shell structure shown in Table 1 were used instead of the SBR latex were prepared (Samples 109–130). Samples 104 to 108 were also prepared in a similar manner by using latexes shown in Table 3 instead of the SBR latex used for Sample 101.

The latexes shown in Table 3 were prepared according to the synthesis method of the exemplary compound P-5, which was specifically explained in Synthesis Example, by changing the monomer composition as shown in Table 3.

These samples were stored for 10 days in an atmosphere of 25° C. and relative humidity of 60%, and then evaluated as follows.

TABLE 2

| Sample No. | Compound No. in Table 1 or 3 | Tg of core part (° C.) | Tg of shell part (° C.) | Core/shell ratio (wt ratio) | Brittle-ness | Surface condition | Image storability | Note |
|---|---|---|---|---|---|---|---|---|
| 101 | C-1 | 20* | 20 | — | ◎ | ◎ | 100 | Comparative (uniform) |
| 102 | C-2 | 0* | 0 | — | ◎ | ◎ | 255 | Comparative (uniform) |
| 103 | C-3 | 43* | 43 | — | X | X | 75 | Comparative (uniform) |
| 104 | C-4 | 60 | 20 | 50:50 | Δ | Δ | 102 | Comparative (core/shell) |
| 105 | C-5 | 61 | 0 | 50:50 | ○ | ◎ | 255 | Comparative (core/shell) |
| 106 | C-6 | 15 | 45 | 49:51 | Δ | Δ | 79 | Comparative (core/shell) |
| 107 | C-7 | 15 | 55 | 49:51 | Δ | Δ | 70 | Comparative (core/shell) |
| 108 | C-8 | 60 | −20 | 50:50 | ◎ | ◎ | 432 | Comparative (core/shell) |
| 109 | P-25 | −11 | 31 | 50:50 | ◎ | ◎ | 72 | Invention |
| 110 | P-19 | −11 | 47 | 50:50 | ◎ | ◎ | 75 | Invention |
| 111 | P-21 | 10 | 47 | 50:50 | ◎ | ◎ | 69 | Invention |
| 112 | P-24 | 10 | 62 | 50:50 | ◎ | ◎ | 66 | Invention |
| 113 | P-12 | 9 | 84 | 50:50 | ○ | ◎ | 62 | Invention |
| 114 | P-16 | 10 | 98 | 50:50 | ○ | ○ | 61 | Invention |
| 115 | P-18 | −2 | 47 | 50:50 | ◎ | ◎ | 69 | Invention |
| 116 | P-5 | 0 | 67 | 50:50 | ◎ | ◎ | 64 | Invention |
| 117 | P-7 | 0 | 79 | 50:50 | ◎ | ◎ | 63 | Invention |
| 118 | P-22 | 1 | 99 | 50:50 | ◎ | ◎ | 63 | Invention |
| 119 | P-17 | −19 | 47 | 50:50 | ◎ | ◎ | 66 | Invention |
| 120 | P-2 | −23 | 52 | 50:50 | ◎ | ◎ | 68 | Invention |
| 121 | P-14 | −20 | 61 | 50:50 | ◎ | ◎ | 65 | Invention |
| 122 | P-23 | −20 | 78 | 50:50 | ◎ | ◎ | 62 | Invention |
| 123 | P-13 | −21 | 98 | 50:50 | ◎ | ◎ | 62 | Invention |
| 124 | P-9 | −41 | 69 | 40:60 | ◎ | ◎ | 64 | Invention |
| 125 | P-1 | −46 | 100 | 50:50 | ◎ | ◎ | 65 | Invention |
| 126 | P-26 | −60 | 47 | 50:50 | ◎ | ◎ | 66 | Invention |
| 127 | P-4 | 0 | 67 | 35:65 | ◎ | ◎ | 62 | Invention |
| 128 | P-6 | 0 | 67 | 60:40 | ◎ | ◎ | 66 | Invention |
| 129 | P-15 | −21 | 62 | 30:70 | ◎ | ◎ | 60 | Invention |
| 130 | P-20 | −22 | 63 | 70:30 | ◎ | ◎ | 61 | Invention |

Samples 101 to 103 used latex of polymer particles having uniform structure

TABLE 3

| No. | Structure | | Core/Shell ratio | Tg (° C.) | Molecular weight | Concentration (wt %) | Particle diameter (nm) | MFT (° C.) |
|---|---|---|---|---|---|---|---|---|
| C-1 | Uniform | Styrene (72)/butadiene (28) | — | 20 | Crosslinked | 41.2 | 110 | 25 |
| C-2 | Uniform | Styrene (63)/butadiene (37) | — | 0 | Crosslinked | 39.6 | 109 | 11 |
| C-3 | Uniform | Styrene (78.5)/butadiene (18.5)/acrylic acid (3) | — | 43 | Crosslinked | 38.2 | 97 | 49 |
| C-4 | Core | Styrene (87.5)/butadiene (12.5) | 50 | 60 | Crosslinked | 37.2 | 99 | 40 |
| | Shell | Styrene (72)/butadiene (28) | 50 | 20 | Crosslinked | | | |
| C-5 | Core | Styrene (88)/butadiene (12) | 50 | 61 | Crosslinked | 40.2 | 105 | 20 |
| | Shell | Styrene (60)/butadiene (37)/acrylic acid (2) | 50 | 0 | Crosslinked | | | |
| C-6 | Core | Styrene (70)/butadiene (30) | 49 | 15 | Crosslinked | 43.2 | 98 | 43 |
| | Shell | Styrene (80.5)/butadiene (17.5)/acrylic acid (2) | 51 | 45 | Crosslinked | | | |
| C-7 | Core | Styrene (70)/butadiene (30) | 49 | 15 | Crosslinked | 39.9 | 102 | 47 |
| | Shell | Styrene (86)/butadiene (14) | 51 | 55 | Crosslinked | | | |
| C-8 | Core | Styrene (87.5)/butadiene (12.5) | 50 | 60 | Crosslinked | 40.0 | 89 | 0 |
| | Shell | Styrene (49)/butadiene (48)/acrylic acid (3) | 50 | −20 | Crosslinked | | | |

Evaluation (1) Film-forming property

Surface condition of the samples after coating was observed by visual inspection (practically acceptable conditions are those indicated with ◎ and ○).

◎: Transparent

○: Transparent, but slightly low gross of surface

Δ: Little haze

X: Significant haze (2) Brittleness

An adhesive tape (Cellotape, width: 2.5 cm, Nichiban Co., Ltd.) was adhered to each sample after coating that was cut into a rectangular shape of a width of 5 cm and length of 20 cm at the cutting edge, and left standing in an environment of 25° C. for 1 hour. Then, the tape was peeled, and the peeled portion of the coating was observed by visual inspection using a microscope (practically acceptable conditions are those indicated with ◎ and ○).

◎: No exfoliation.

○: Fine exfoliation was partially observed

Δ: Fine exfoliation was observed

X: Significant exfoliation was observed.

XX: Exfoliation was observed for the whole surface.

(3) Image storability

Each of the photographic materials was light-exposed and heat-developed (at about 120° C.) by using Fuji Medical Dry Laser Imager FM-DP L (equipped with a semiconductor laser of 660 nm and a maximum output of 60 mW (IIIB)), and density of fogging portion of the obtained image was measured. Then, the developed sample was left under a heated dark condition (temperature: 60° C., humidity: 65%) for 1 day, and change of the density of fogging portion (increase of density) was measured. The results are shown as relative values based on the value obtained for Sample 101, which is taken as 100.

The results of above (1) to (3) are also shown in Table 2. According to the present invention, thermally processed image recording materials showing superior film-forming property, brittleness and image storability could be provided.

What is claimed is:

1. A thermally processed image recording material having an image-forming layer that contains a non-photosensitive silver salt of an organic acid, a reducing agent for silver ions and a binder on a support, wherein the binder is coated as a dispersion of polymer microparticles having a core/shell structure, glass transition temperature of shell part of the core/shell structure is higher than glass transition temperature of core part of the core/shell structure, and the binder shows a minimum film-forming temperature of 30° C. or lower.

2. The thermally processed image recording material according to claim 1, wherein the glass transition temperature of the core part of the core/shell structure is 10° C. or lower.

3. The thermally processed image recording material according to claim 2, wherein the glass transition temperature of the core part of the core/shell structure is within the range of −30° C. to 10° C.

4. The thermally processed image recording material according to claim 3, wherein the glass transition temperature of the core part of the core/shell structure is within the range of −20° C. to 5° C.

5. The thermally processed image recording material according to claim 1, wherein the glass transition temperature of the shell part of the core/shell structure is 40° C. or higher.

6. The thermally processed image recording material according to claim 5, wherein the glass transition temperature of the shell part of the core/shell structure is within the range of 50° C. to 100° C.

7. The thermally processed image recording material according to claim 6, wherein the glass transition temperature of the shell part of the core/shell structure is within the range of 60° C. to 80° C.

8. The thermally processed image recording material according to claim 1, wherein the difference of the glass transition temperature of the core part and the glass transition temperature of the shell part is within the range of 30° C. to 130° C.

9. The thermally processed image recording material according to claim 8, wherein the difference of the glass transition temperature of the core part and the glass transition temperature of the shell part is within the range of 55° C. to 100° C.

10. The thermally processed image recording material according to claim 1, wherein the polymers of the core part and the shell part mainly consist of homopolymers or copolymers of acryl and methacryl resins, styrene resins, conjugated diene resins, vinyl chloride resins, vinyl acetate resins, vinylidene chloride resins and polyolefin resins.

11. The thermally processed image recording material according to claim 10, wherein the polymers of the core part and the shell part contain one or more kinds of conjugated dienes as the constitutive monomers.

12. The thermally processed image recording material according to claim 1, wherein the weight ratio of the core part in the core/shell structure is within the range of 10 to 90 weight %.

13. The thermally processed image recording material according to claim 12, wherein the weight ratio of the core part in the core/shell structure is within the range of 20 to 80 weight %.

14. The thermally processed image recording material according to claim 13, wherein the weight ratio of the core part in the core/shell structure is within the range of 30 to 70 weight %.

15. The thermally processed image recording material according to claim 1, wherein the binder shows a minimum film-forming temperature of −50° C. to 20° C.

16. The thermally processed image recording material according to claim 15, wherein the binder shows a minimum film-forming temperature of −20° C. to 15° C.

17. The thermally processed image recording material according to claim 1, wherein the dispersion of polymer microparticles is latex prepared by emulsion polymerization.

18. The thermally processed image recording material according to claim 1, wherein the image-forming layer further contains a photosensitive silver halide.

19. The thermally processed image recording material according to claim 1, wherein the particle size of the polymer microparticles having the core/shell structure is 300 nm or less.

20. The thermally processed image recording material according to claim 19, wherein the particle size of the polymer microparticles having the core/shell structure is 200 nm or less.

* * * * *